US005240368A

United States Patent [19]

Graef et al.

[11] Patent Number: 5,240,368

[45] Date of Patent: Aug. 31, 1993

[54] SHEET HANDLING APPARATUS

[75] Inventors: Harry T. Graef, Bolivar; Damon J. Blackford, Akron; Timothy R. Crewe, Alliance, all of Ohio

[73] Assignee: Diebold, Inc., Canton, Ohio

[21] Appl. No.: 765,471

[22] Filed: Sep. 25, 1991

Related U.S. Application Data

[63] Continuation of Ser. No. 445,564, Dec. 4, 1989, abandoned.

[51] Int. Cl.[5] ..... B65H 31/02

[52] U.S. Cl. ..... 414/788.9; 271/12; 271/188; 271/264; 414/790.3; 902/16; 902/17

[58] Field of Search ..... 209/534; 271/3.1, 6, 271/7, 12, 161, 188, 209, 264; 414/786, 789.9, 790.3, 790.7, 788.9; 902/13, 16, 17

[56] References Cited

U.S. PATENT DOCUMENTS

| | | | |
|---|---|---|---|
| 1,973,041 | 9/1934 | Birkmeyer . | |
| 2,028,236 | 1/1936 | Needham . | |
| 2,922,645 | 1/1960 | Hurlbut . | |
| 3,904,192 | 9/1975 | Pfeifer et al. . | |
| 3,944,213 | 3/1976 | Fallos et al. . | |
| 3,944,214 | 3/1976 | Fallos et al. . | |
| 4,056,264 | 11/1977 | Dhooge et al. . | |
| 4,088,314 | 5/1978 | Phillips . | |
| 4,145,041 | 3/1979 | Kew . | |
| 4,214,740 | 7/1980 | Acquaviva . | |
| 4,275,874 | 6/1981 | DiBlasio . | |
| 4,350,332 | 9/1982 | Knight . | |
| 4,351,520 | 9/1982 | Tanaka . | |
| 4,357,126 | 11/1982 | Kidd et al. . | |
| 4,434,359 | 2/1984 | Watanabe | 902/13 X |
| 4,470,590 | 9/1984 | Ariga et al. . | |
| 4,577,763 | 3/1986 | Placke et al. | 209/534 |
| 4,589,650 | 5/1986 | Miyoshi . | |
| 4,618,302 | 10/1986 | Kokubo et al. | 414/789.9 |
| 4,648,591 | 3/1987 | Osmera et al. | 271/209 X |
| 4,670,643 | 6/1987 | Hain et al. | 235/449 X |
| 4,736,571 | 4/1988 | Bucolt . | |
| 4,928,944 | 5/1990 | Golicz | 271/6 |

FOREIGN PATENT DOCUMENTS

| | | | |
|---|---|---|---|
| 357406 | 3/1990 | European Pat. Off. | 209/534 |
| 1-60527 | 3/1989 | Japan | 271/161 |

OTHER PUBLICATIONS

Exhibit A, Receipt Tape Transport Mechanism, Nov. 4, 1988.

*Primary Examiner*—Michael S. Huppert
*Assistant Examiner*—Janice Krizek
*Attorney, Agent, or Firm*—D. Peter Hochberg; Mark Kusner; Michael Jaffe

[57] ABSTRACT

A device for dispensing sheet media comprising a storage location for storing sheet media to be dispensed; a receiving location accessible to a patron from which the sheet media may be received; a receptacle for retaining sheets of the media; a stacking assembly for stacking individual sheets of the sheet media into a stack; a transport assembly for transporting individual sheets from the storage assembly to the stacking assembly and for transporting sheets of the media from the receiving assembly to the receptacle; a transfer assembly for transferring a stack of sheets from the stacking assembly to the receiving location; and, a divert assembly associated with the transport assembly operable to cause sheets transported from the storage location to the stacking assembly to be diverted to the receptacle.

35 Claims, 16 Drawing Sheets

SHEET HANDLING APPARATUS

This is a continuation of co-pending application Ser. No. 07/445,564 filed on Dec. 4, 1989 now abandoned.

FIELD OF THE INVENTION

The present invention relates generally to handling and transport apparatus and more particularly to mechanisms for handling and feeding sheet media. The present invention is particularly applicable to a device for transporting sheet media such as currency, tickets, coupons and the like, in an Automatic Teller Machine (ATM) and will be described with particular reference thereto, although the present invention may find advantageous application in other apparatus utilizing sheet feeding and handling mechanisms.

BACKGROUND OF THE INVENTION

The present invention relates generally to a sheet media handling and dispensing device for use in an Automatic Teller Machine (ATM), which device is capable of handling individual sheet media, such as currency, coupons, tickets and the like, as well as feeding a stack of such sheet media to a dispensing location.

Sheet media transfer devices known heretofore, particularly currency transfer devices, have generally utilized roller systems or belt systems for driving and feeding the sheet media (currency) within the device. Roller transfer systems are typically comprised of cooperating pairs of opposed rollers wherein each opposed roller is rotated in an opposite direction to drive the sheet media therebetween. Such pairs of opposed rollers are generally disposed side-by-side, as well as in succession to form a path along which the individual sheet media is to be fed. Belt systems operate in a similar fashion by driving the sheet media between facing surfaces of opposed belts. Both types of systems thus operate by frictionally gripping and driving the sheet media. Such systems typically require precise alignment between successive pairs of rollers or belts to ensure proper operation of the device. In addition, such systems require precise timing between each roller or belt in the system. In this respect, if a particular roller or belt is moving too slowly in relation to a successive roller or belt, the sheet media may tear as the successive roller or belt accelerates the leading edge of the sheet. If the roller or belt is moving too quickly in relation to the next roller or belt, the deceleration of the leading edge may cause the sheet to buckle and replicate itself which may jam the system. Accordingly, rollers and belts in systems known heretofore are typically interconnected by timing chains or belts and are generally driven by a single large motor which generally has a high power consumption.

Because of the intricacies of such systems, together with the high-speed at which such devices normally operate, even slight misalignment or force imbalances can cause excessive wear among the components, and more importantly can create document jammings in the transport assemblies. Moreover, the intricacies and precise alignment found in these systems also makes access to and removal of jammed sheets difficult.

The present invention overcomes these and other problems by providing a sheet media dispensing device which is less complicated than currency feeding and handling systems known heretofore. The present invention provides a sheet media dispensing device which utilizes a plurality of moving belts in operative relationship to a stationary surface to transport sheet material along a path defined by the stationary surface.

SUMMARY OF INVENTION

In accordance with the present invention there is provided a device for handling and feeding sheet media comprising surface means including at least two spaced-apart, side-by-side, parallel elongated surfaces, said elongated surfaces lying in a common plane and defining a path along which the sheets are to be driven. At least three spaced-apart side-by-side, endless drive belts, each having an outer frictional surface extending along the surface means are provided wherein a portion of the belts and the outer frictional surfaces thereof are disposed facing and generally parallel to the surface means, the portions of the drive belts facing the surface means being parallel to and juxtaposed with the elongated surfaces to define an undulating passage therebetween, which passage confines the sheets between the frictional surface of the drive belts and the elongated surfaces. Belt drive means are provided for simultaneously driving the belts such that the sheets confined between the elongated surface and frictional surface of the moving belts are driven along the elongated surfaces by the moving belts.

In accordance with another aspect of the present invention there is provided a sheet handling and feeding device, as defined above, further comprising a first location for receiving individual media sheets from a storage location, a second location for presenting the media as a single sheet or a stack of sheets, a third location for storing predetermined ones of the sheets in the first location, stacking means for stacking individual sheets into a stack of sheets, transport means for feeding individual sheets from the first location to the means for stacking or from the second location to the third location, transfer means for transferring a stack of sheets from the means for stacking to the second location, sensing means for sensing the predetermined ones of the sheets from the storage location, and divert means responsive to the sensing means for diverting the predetermined ones of the sheets from the stacking means to the third location.

A primary object of the present invention is to provide a sheet media handling and feeding device which is less complicated and less intricate than existing machines.

Another object of the present invention is to provide a device as defined above having a media transfer assembly wherein the timing and operational speeds of the media transfer assembly are not critical and wherein the media transfer assembly is less susceptible to wear.

Another object of the present invention is to provide a device as defined above which is less susceptible to jamming.

Another object of the present invention is to provide a device as defined above wherein the operative components of the transfer mechanism have no surface-to-surface engagement and the sheet media is directed along paths without physical guides.

A further object of the present invention is to provide a device as defined above wherein the operative transfer mechanism is comprised of moving belts disposed in relation to stationary surfaces.

A further object of the present invention is to provide a device as defined above for feeding and handling sheet media in an Automatic Teller Machine (ATM).

A further object of the present invention is to provide a device as defined above which includes means for stacking individual bills or currency in an ATM into a stack and presenting such stack at a predetermined location in the device.

A further object of the present invention is to provide a device as defined above for use in an ATM which device is capable of handling sheet media of various sizes at the same time.

A still further object of the present invention is to provide a device as defined above which includes means for sensing certain bills and diverting such bills to a storage location.

These and other objects and advantages of the invention will become apparent from the following description of an embodiment thereof taken together with the accompanying drawings.

DESCRIPTION OF THE DRAWINGS

The invention may take physical form in certain parts and arrangement of parts, preferred embodiments of which will be described in detail in this specification and illustrated in the accompanying drawings wherein.

DETAILED DESCRIPTION OF PREFERRED EMBODIMENT

Figure 1:
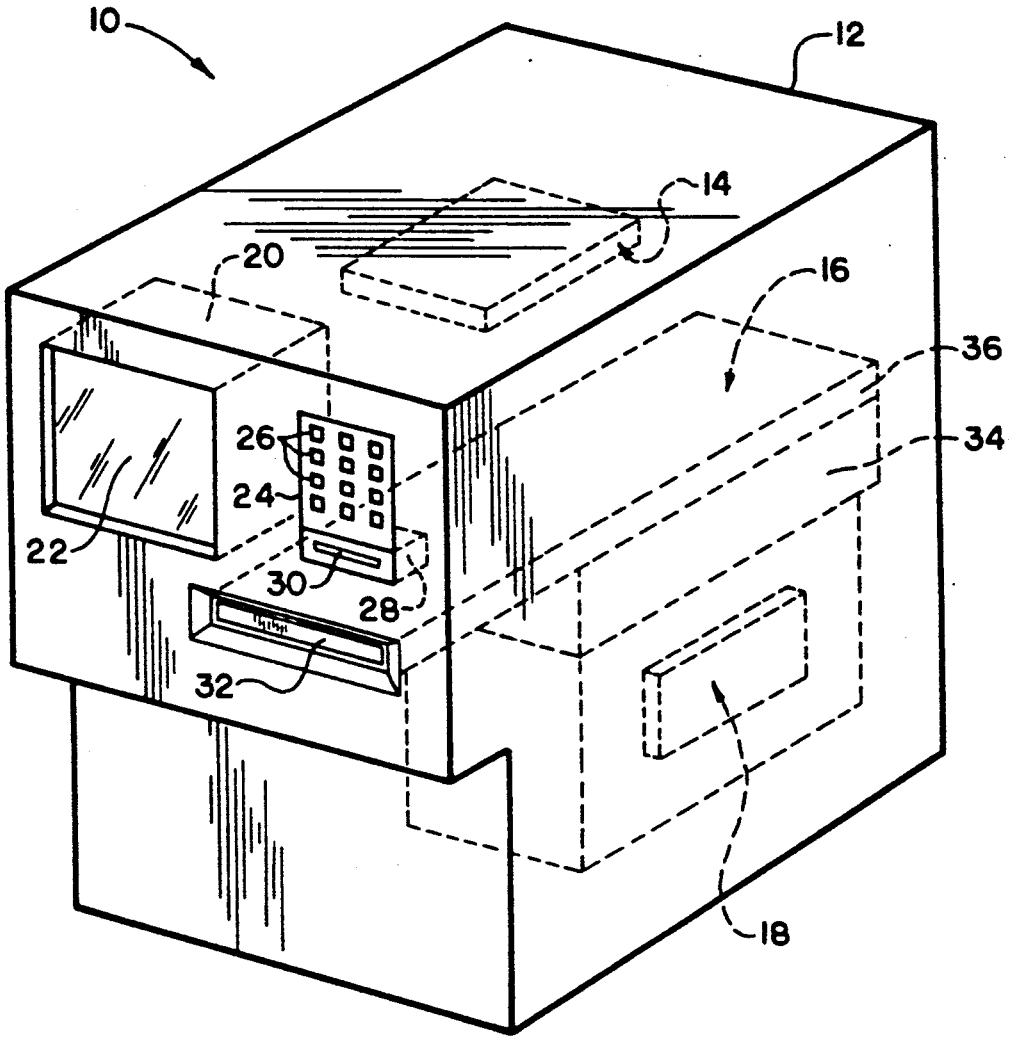
FIG. 1 is a perspective schematic representation of an Automatic Teller Machine (ATM) according to the present invention illustrating several major components thereof in phantom.
Figure 2:
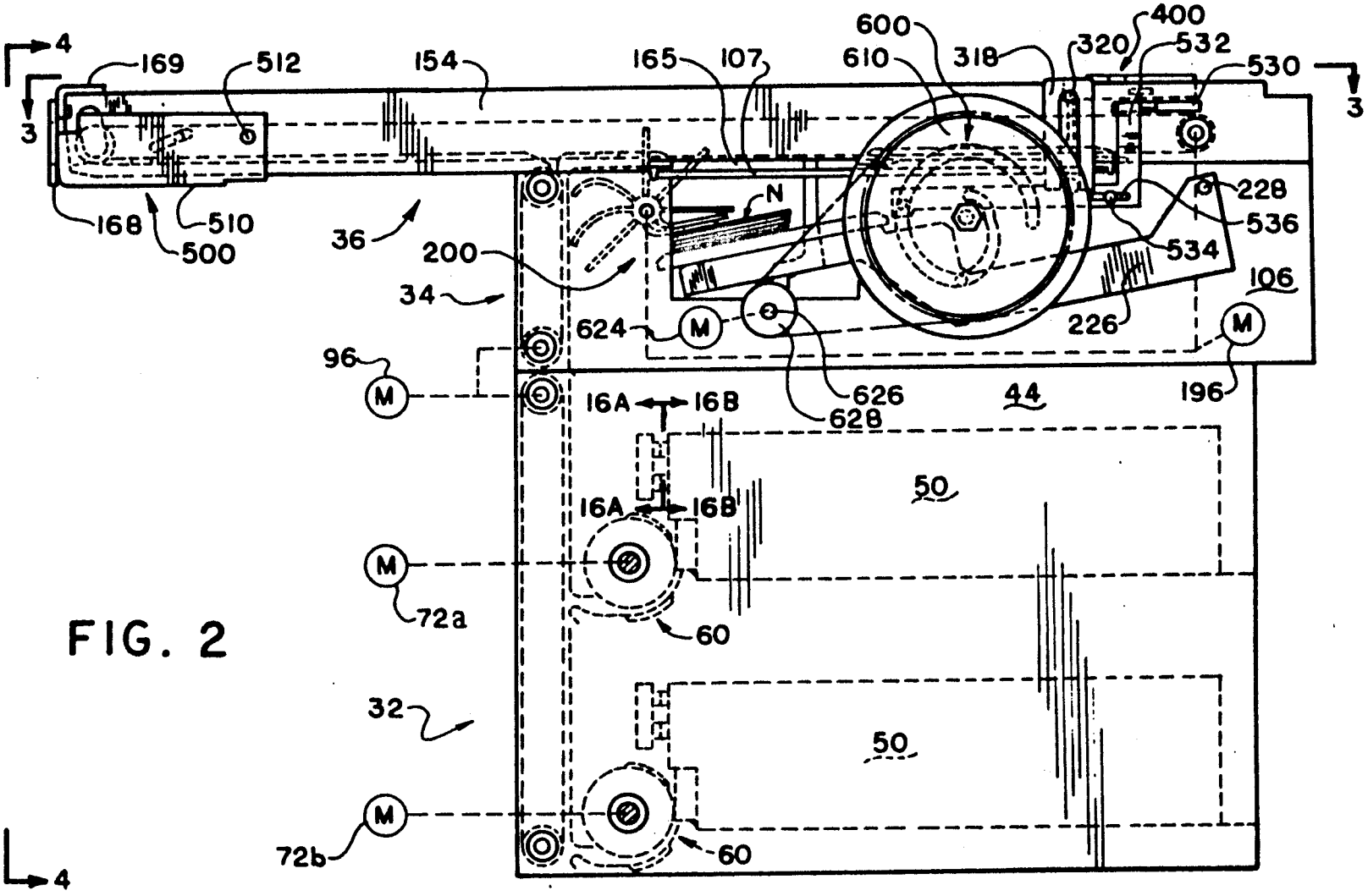
FIG. 2 is a side elevational view of a sheet media dispensing mechanism illustrating a preferred embodiment of the present invention.

Referring now to the drawings wherein the showing is for the purpose of illustraing preferred embodiments of the invention only and not for the purpose of limiting same, the drawings illustrate a card operated Automatic Teller Machine (ATM) 10 according to the present invention for dispensing sheet media such as currency, traveller's checks, tickets, coupons, and the like. Hereinafter, for purposes of clarity and convenience, such sheet media, i.e. currency, traveller's checks, etc., shall be referred to as "notes" or "a note", it being understood that the present invention finds advantageous application to the identified sheet media and others. Machine 10 is intended to dispense notes upon request to individuals meeting predetermined criteria. Machine 10, which is schematically represented in FIG. 1, includes a cabinet or housing 12 which encloses an ATM processor 14, a media dispensing mechanism 16, hereinafter referred to as a "media dispenser 16", and dispenser processor 18 for controlling the operation of media dispenser 16.

ATM processor 14 basically controls the personal aspects of the dispensing routine (i.e. the financial record keeping aspects and customer interface) of ATM 10. To facilitate these functions, associated with ATM processor 14 are a video monitor 20 having a screen 22 exposed to the exterior of housing 12, a keypad 24 including a plurality of operational keys 26 for use by a customer for entering information to processor 14, and a card reader 28 for reading information from conventionally-known cards having identification data encoded thereon. A card is inserted into card reader 28 through a card slot 30 provided in housing 12. A currency dispensing opening 32 is provided in housing 12 for dispensing currency to users of ATM 10.

Figure 3:
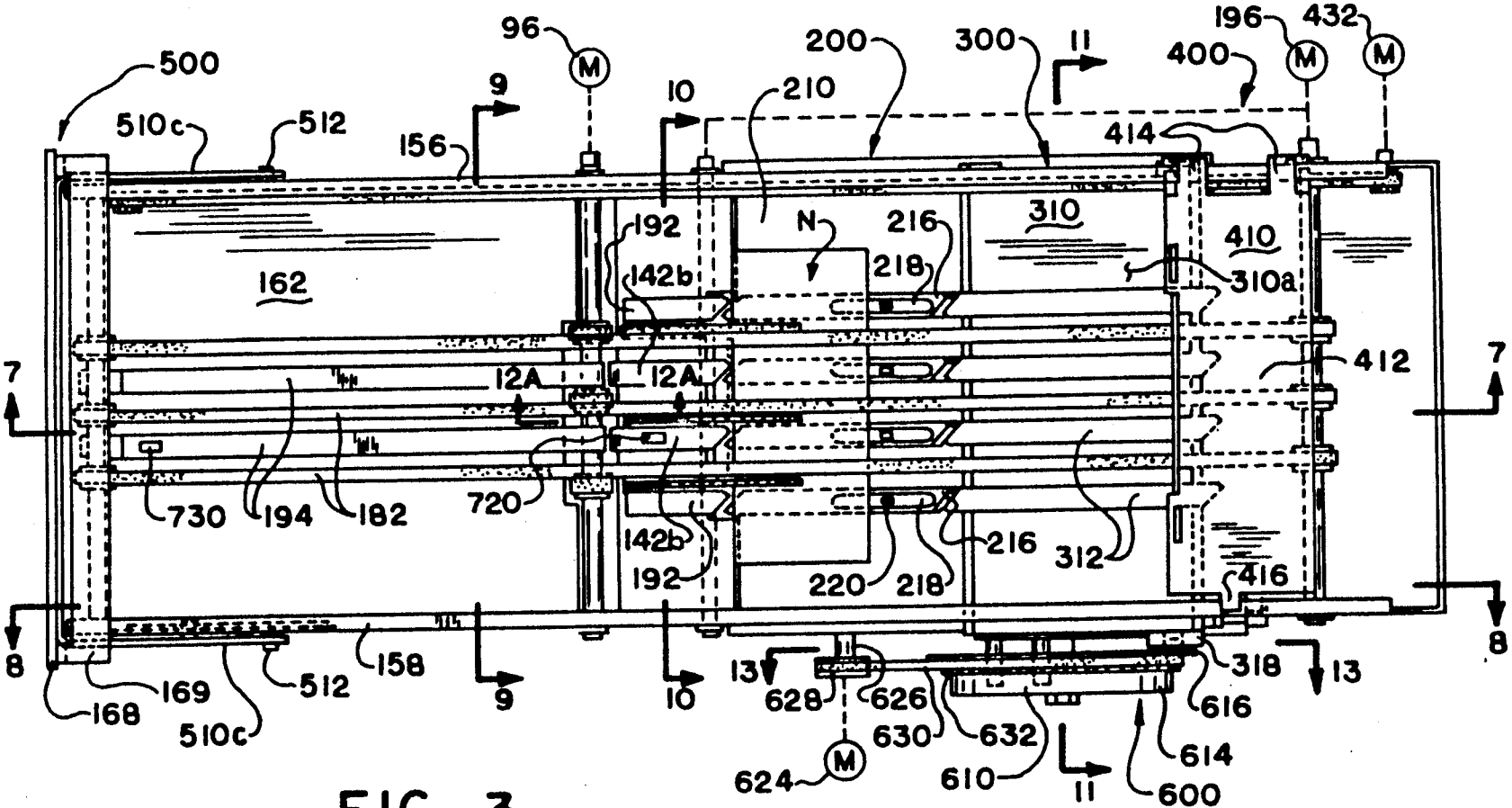
FIG. 3 is a top plan view of the sheet media dispensing mechanism shown in FIG. 2, taken along line 3—3 of FIG. 2.
Figure 4:
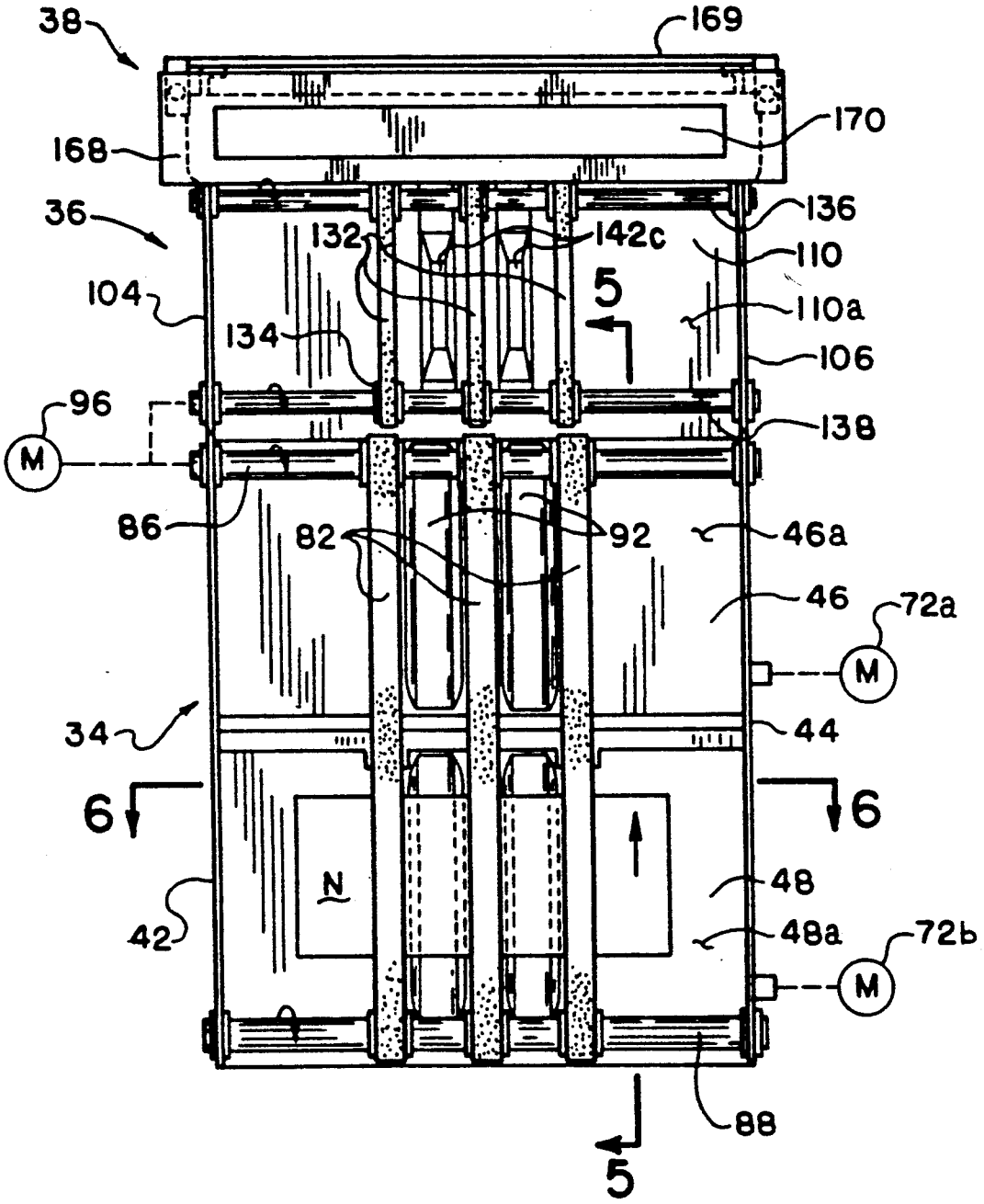
FIG. 4 is an end elevational view taken along line 4—4 of FIG. 2.
Figure 5:
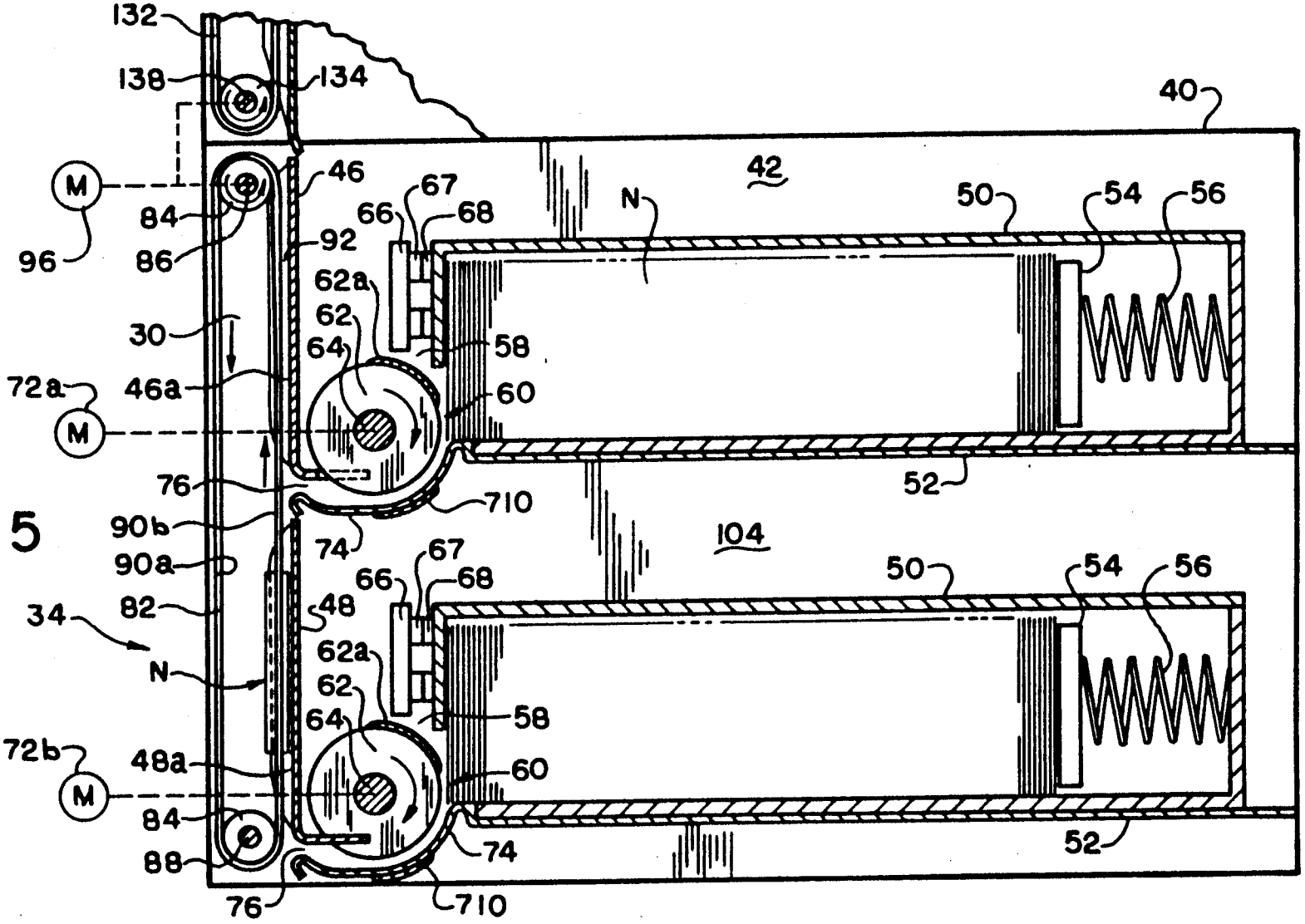
FIG. 5 is an enlarged sectional view taken along line 5—5 of FIG. 4 showing a media canister and a feed module according to a preferred embodiment of the present invention.
Figure 16B:
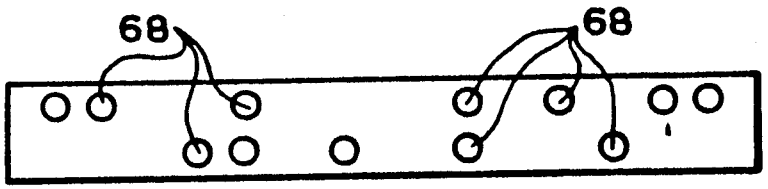
FIGS. 16A & 16B are sectional views taken along lines 16A—16A and lines 16B—16B of FIG. 2 illustrating a switch arrangement used to identify parameters of the media contained in media canisters; and, FIG. 17 is a block diagrammatic representation of the internal electronic control system for the embodiment shown.
Figure 16A:
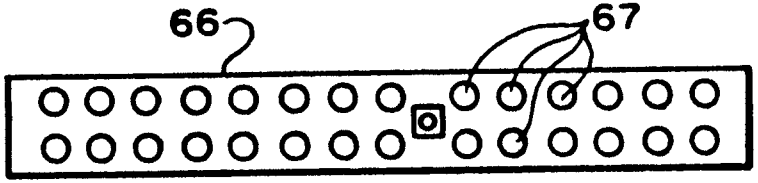

Referring now to FIGS. 2–8, in the embodiment shown, media dispenser 16 is generally comprised of the three separate modules, namely a bottom module hereinafter referred to as a "feed module" and designated "34" in the drawings, an intermediate module hereinafter referred to as a "stacking module" and designated "36" in the drawings, and a top module referred to as a "transport module" and designated "38" in the drawings. Feed module 34, best seen in FIG. 5, is generally a storage location for the media to be dispensed by the ATM 10 and is comprised of a housing 40 having side walls 42, 44. A pair of vertically-aligned panels 46, 48 form the front end of housing 40. Panels 46, 48 include outwardly facing, generally planar surfaces 46*a*, 48*a* which are aligned and co-planar to each other. The back of housing 40 is open to receive conventionally-known money canisters 50 on shelves 52. Canisters 50 in and of themselves form no part of the present invention and therefore shall not be described in greater detail. Canisters 50 are basically rectangular boxes which hold a stack of sheet media, i.e. notes N. The stack is biased by a push plate 54 and biasing means 56 toward an opening 58 at one end of canister 50. A picker assembly 60 is provided adjacent opening 58 of each canister 50 to remove ("pick") individual notes N from canisters 50. Picker assembly 60 is comprised of a cylindrical roller 62 which is rotatable about a shaft 64. Roller 62 includes a raised pad 62*a* which is operable to engage and remove ("pick") the exposed note N in opening 58 of the canister 50, . . . one note N being "picked" during each single revolution of roller 62. In the embodiment shown, each roller 62 is preferably driven by a separate, independently operated motor, designated 72*a*, 72*b* and schematically illustrated in the drawings. Motors 72*a*, 72*b* are preferably stepping motors and include sensing means (not shown) for monitoring each revolution of the roller 62, as well as the position of raised pad 62*a* relative to opening 58. Below each roller 62 an arcuate wall 74 is provided. A slot or opening 76 is defined between the end of arcuate wall 74 and the lower end of each panel 46, 48. To identify the particular canister 50 inserted into feed module 34 and particulars of the sheet media therein, a keyboard 66 having a plurality of switches 67 arranged in rows thereon is mounted in module 34 and connected to dispenser processor 18. Keyboard 66, illustrated in FIG. 16A, is positioned to be aligned with corresponding rows of removable actuating pins 68 provided on the end of canister 50 above opening 58, illustrated in FIG. 16B. By inserting actuating pins 68 at specific locations on canister 50, when inserting canister 50 into feed module 34 against keyboard 66 only corresponding switches 67 are actuated. Using such an arrangement, the specific canister inserted in feed module 34 can be identified, together with other parameters such as the particular type of note N contained in canister 50, the height of the note and the note's thickness.

Figure 6:
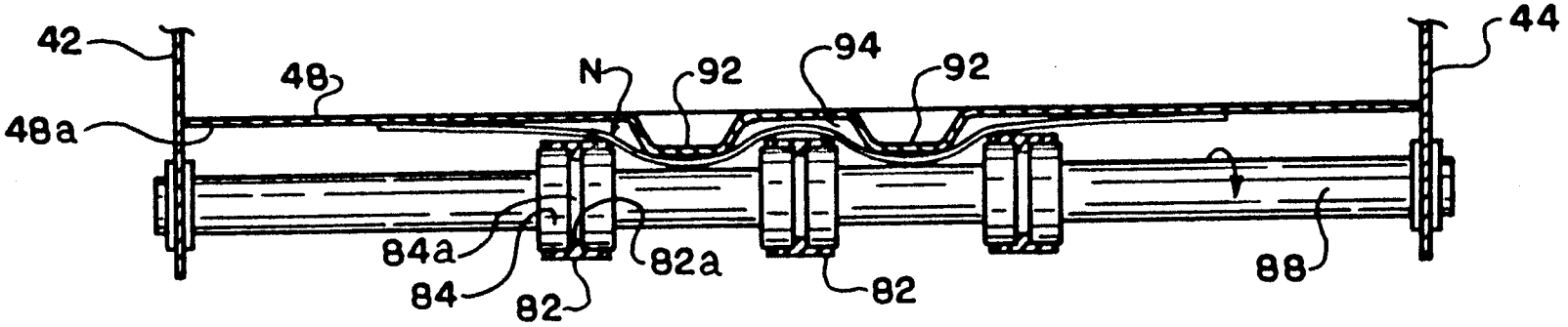
FIG. 6 is an enlarged sectional view taken along line 6—6 of FIG. 4.

According to one aspect of the present invention, a vertical currency transport 80 for conveying individual notes picked from canisters 50 to stacking module 36 is provided. Vertical transport 80 is basically comprised of a plurality of endless belts in operative relationship with stationary surfaces. More specifically, in the embodiment shown, three identical, endless, side-by-side and parallel belts 82 are mounted on rollers 84. Rollers 84 are fixedly mounted to shafts 86, 88 and include annular grooves 84*a* to receive ribs 82*a* on belts 82, as best seen in FIG. 6. Shafts 86, 88 are positioned in housing 40 such that belts 82 define two parallel belt flights 90*a* and 90*b* wherein flight 90*b* is adjacent to and a predetermined distance from surfaces 46*a*, 48*a*, of panels 46, 48. In this respect, each belt 82 has an outer frictional surface which faces surfaces 46*a*, 48*a* along flight 90*b*. As best illustrated in FIG. 6, surfaces 46*a* (not shown) and 48*a* each include a pair of side-by-side parallel rails 92 which project therefrom. Rails 92 are juxtaposed relative to the belts 82 such that a rail 92 is disposed between each adjacent belt 82. In the embodiment shown, rails 92 are integrally formed in panels 46*a*, 48*a*, but as will be seen below, rails 92 may be separate components attached to planar surfaces. An undulated or corrugated passage 94 is formed between the belts 82 and rails 92, as will be discussed in greater detail below. Belts 82 and rails 92 have a predetermined dimension and are spaced apart a predetermined distance such that a note N confined between belts 82 and rails 92 will be driven along rails 92 in the direction belts 82 are moving. Accordingly, rails 92 and surfaces 46*a*, 48*a* are preferably smooth to enable notes N to move therealong. Shaft 86 is preferably driven by a conventionally-known brush motor 96, which is schematically illustrated in the drawings, having conventionally-known speed sensing means (not shown) associated therewith.

Figure 7:
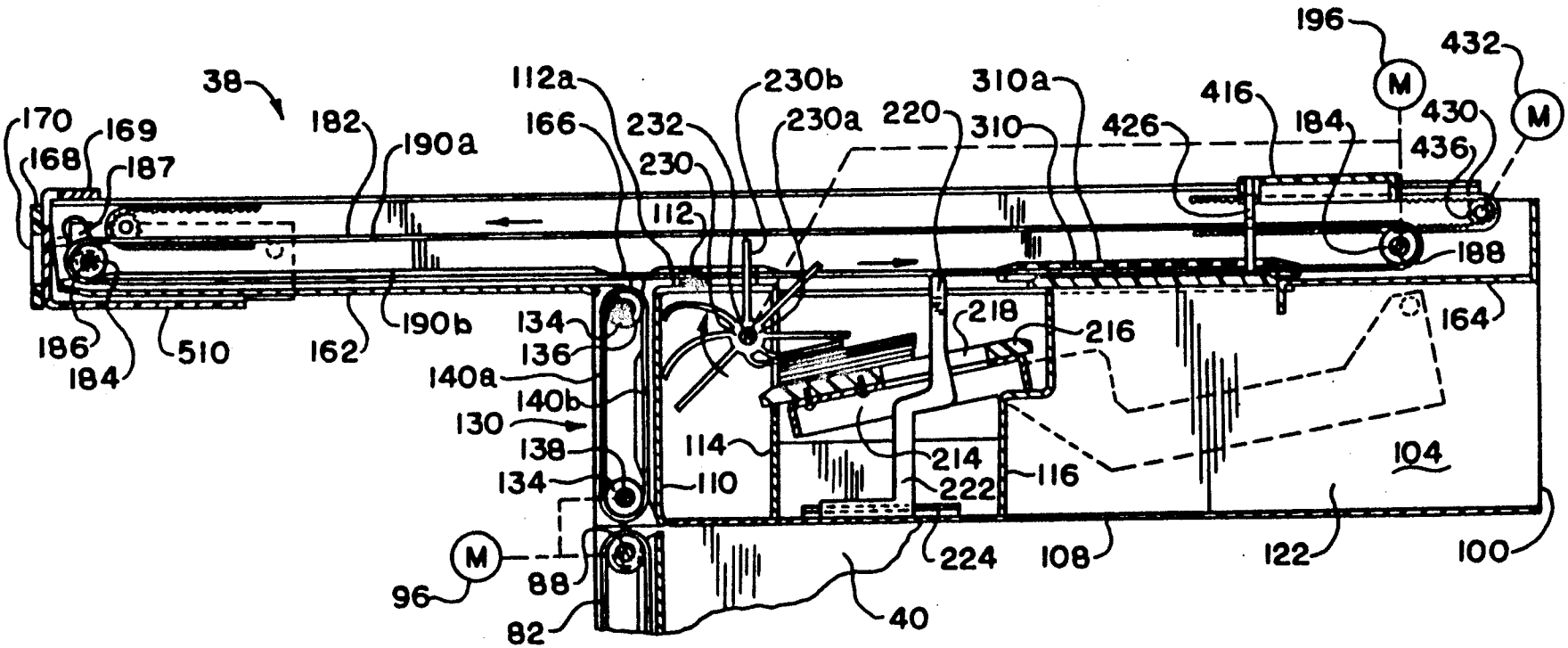
FIG. 7 is a sectional view taken along line 7—7 of FIG. 3.

Referring now to FIGS. 2–4 and 7–12, stacking module 36 is generally comprised of a rectangular housing 100 formed by two side walls 104, 106, a bottom wall 108, and a plurality of transverse walls 110, 112, 114, and 116 as best seen in FIG. 7. Transverse walls 110, 112, 114, and 116 define three compartments or chambers 118, 120, 122 within housing 100 wherein compartments 120, 122 are open on the top. The upper ends of side walls 104, 106 include outwardly extending flanges 105, 107 respectively, best seen in FIG. 11. Transverse walls 110, 112 define outward facing planar surfaces 110*a*, 112*a* respectively. In the embodiment shown, stacking module 36 includes a vertical transport 130 along one end wall of the housing 100. Vertical transport 130 is basically similar to the vertical transport 80 on feed module 34 and is dimensioned to be aligned therewith. In this respect, vertical transport 130 includes three generally identical side-by-side and parallel belts 132 which are mounted on rollers 134 on shafts 136 and 138. As best seen in FIG. 7, shafts 136, 138 are spaced apart vertically and positioned to define parallel belt flights 140*a*, 140*b* wherein belt flight 140*b* is disposed adjacent and parallel to surface 110*a* of transverse wall 110. Belts 132 include outer frictional surfaces which face planar surface 110*a* along flight 140*b*. Two generally L-shaped rails 142 (best seen in FIGS. 12A and 12B) are provided for mounting on stacking module housing 100. Rails 142 include leg portions 142*a*, 142*b* which are mounted on transverse wall sections 110, 112 respectively. Leg portion 142*a* is generally lower (flatter) than leg portion 142*b*, and includes a laterally and longitudinally tapered ridge 142*c* (best seen in FIG. 4). Leg portion 142*b*, in addition to being higher, has a more rectangular cross-section. Rails 142 are mounted to housing 100 so that leg portions 142*a* are parallel to and juxtaposed with belts 132 such that a leg portion 142*a* of rail 142 is disposed between each belt 132. In this respect, like vertical transport 80, an undulated or corrugated passage is formed between the belts 132 and the rails 142. In the embodiment shown, shaft 136 is driven simultaneously with shaft 86 of vertical transport 80 (by means not shown) by motor 96. Associated with each belt 132 is a pinch roller 146 mounted to transverse wall 110 as best seen in FIGS. 12A and 12B. Pinch rollers 146 are dimensioned to be biased into engagement with belts 132.

Referring now to FIG. 7, transport module 38 is generally comprised of shallow frame 150 having parallel side walls 152, 154. The upper edges of side walls 152, 154 include inwardly extending flanges 156, 158 (best seen in FIG. 9) which extend along the length thereof. Frame 150 includes bottom walls 162, 164 at the distal ends thereof and an open space defined therebetween. Bottom wall 162 includes an upward facing, generally planar surface 162*a*. Frame 150 is mounted on housing 100 wherein bottom wall 164 of frame 150 is above chamber 122 of housing 100. Bottom wall 162 of frame 150 extends beyond housing 100 with the opening between bottom walls 162, 164 being disposed over transverse wall 112, chamber 120, and a portion of chamber 122. Side walls 152, 154 each include a shallow notched-out area which defines a horizontal slot 165 (best seen in FIG. 2) between the lower edges thereof and flanges 105, 107 of housing 100. The upper surface 162*a* of bottom wall 162 is generally aligned and co-planar with surface 112*a* of transverse wall 112 of housing 100. Bottom wall 162 is dimensioned such that a gap or space 166 (best seen in FIG. 8) is defined between the end thereof and transverse wall 112. A plate 168 having a dispensing slot 170 is mounted at the dispensing end of frame 150. Slot 170 is dimensioned to correspond to slot 32 in housing 12. Plate 168 is mounted to an angle-shaped member 169 which in turn is mounted to side walls 152, 154 of frame 150 wherein a space is defined between plate 168 and the ends of side walls 152, 154.

Transport module 38 includes a horizontal transport 180 for moving the sheet media along a generally horizontal path or plane P. In this respect, horizontal transport 180 is similar to the vertical transport 80 of feed module 34 and transport 130 of stacking module 36 in that it is basically comprised of a plurality of endless belts in operative relationship with a stationary surface having elevated rails thereon. More specifically, horizontal transport 180 includes three generally identical side-by-side parallel belts 182 which are mounted on rollers 184 on shafts 186, 188. As best seen in FIG. 7, the shafts 186, 188 are spaced apart to define generally straight, horizontal belt flights 190*a*, 190*b*. Belts 182 include outer frictional surfaces which face surfaces 112*a* and 162*a*. Shafts 186, 188 are mounted in side walls 152, 154 such that belt flights 190*b* of belts 182 are generally disposed parallel to and a predetermined distance from surfaces 162*a* and 112*a*. More particularly, shaft 186 is mounted in inclined, elongated slots 187 in side walls 152, 154. As seen in the drawings, belts 182 also extend the entire length of transport module frame 150, and over chambers 120, 122 of stacking module 36. As best seen in FIG. 3, belts 182 are juxtaposed with respect to leg portions 142*b* of L-shaped member 142, wherein a leg portion 142*b* is disposed between each belt 182. Supplemental rails 192 are provided on wall 112 as best seen in FIG. 3. Supplemental rails 192 are dimensioned to correspond to leg portions 142*b* of L-shaped rails 142. Bottom wall 162 of frame 150 includes two side-by-side rails 194 which are aligned with leg portions 142*b* and dimensioned to correspond therewith. Importantly, the upper surfaces of rails 142*b*, 192, and 194 are generally aligned and lie in a common plane which defines path P. In other words, the upper surface of rails 142*b*, 192, and 194 define the work path P along which the notes to be dispensed are conveyed. As with vertical transports 80, 130, as undulated passage is defined between belts 182 and rails 142*b*, 192, and 194. Belts 182 are preferably driven by a conventionally-known brush motor 196, which is schematically illustrated in the drawings, having conventionally-known speed sensing means (not shown) associated therewith. In this respect, in the embodiment shown, horizontal transport 180 is driven independently of vertical transports 80 and 130. If desired, however, horizontal transport 180 may be simultaneously driven with vertical transports 80, 130 by a single motor, by means within the purview of those skilled in the art, without detracting from the present invention.

In addition to being in alignment with surfaces 112*a*, 162*a* horizontal transport 180 is disposed to be in operative relationship with a stacking assembly 200 for stacking the sheet media, a divert assembly 300 for diverting notes or dumping a stack of notes to a "divert/dump location", a push plate assembly 400 for transferring a stack of media toward dispensing slot 170, a gate assembly 500 for controlling access to slot 170, and a control assembly 600 for coordinating the actions of stacking assembly 200, divert assembly 300, and gate assembly 500.

STACKING ASSEMBLY 200

According to the preferred embodiment of the present invention, stacking mechanism 200 includes a stack plate 210 best seen in FIG. 7. Stack plate 210 is generally comprised of a platform 214 having a plurality of side-by-side, parallel rails extending thereacross. In the embodiment shown, stack plate 210 includes four side-by-side, parallel rails 216. Rails 216 are basically dimensioned to correspond in cross-section to rails 142*b*, 192, 194, and to extend in alignment therewith. The ends of rails 216 are angled to correspond and to align with the angled ends of rails 142*b*, 192, as best seen in FIG. 3. Stack plate 210 is generally disposed within chamber 120 of stacking module 36. Slots are provided in walls 112, 114 to accommodate the ends of rails 216 to the extent they extend beyond chamber 120. Elongated slots 218 extend through platform 214 and rails 216. Slots 218 are dimensioned to receive vertical tines 220 on a media stop 222. Stop 222 is operable to be repositioned along a guide 224. Stack plate 210 is mounted on a pair of elongated arms 226 which attach to the sides of stack plate 210. Arms 226 extend toward the rear of the housing 100 along the exterior sides thereof and are mounted for pivotal movement on pivot pins 228 (shown in FIG. 2). In this respect, stack plate 210 is pivotally movable with the arms 226 about the pins 228 between a stacking position (best seen in FIG. 7) wherein stacking plate 210 is positioned away from belts 182 and a second position wherein rails 216 of stack plate 210 are aligned with rails 142*b*, 192, 194 and in operative relationship with belts 182. In this position, the upper surfaces of rail 216 are generally co-planar to plane P defined by the upper surfaces of rails 142, 192, and 194. The arm 226 adjacent wall 106 of stacking module 36 includes a laterally extending cam follower 234 (best illustrated in FIGS. 13A–13D) in the form of a roller pin for operative engagement with control assembly 600 which will be described in greater detail below.

Figure 10:
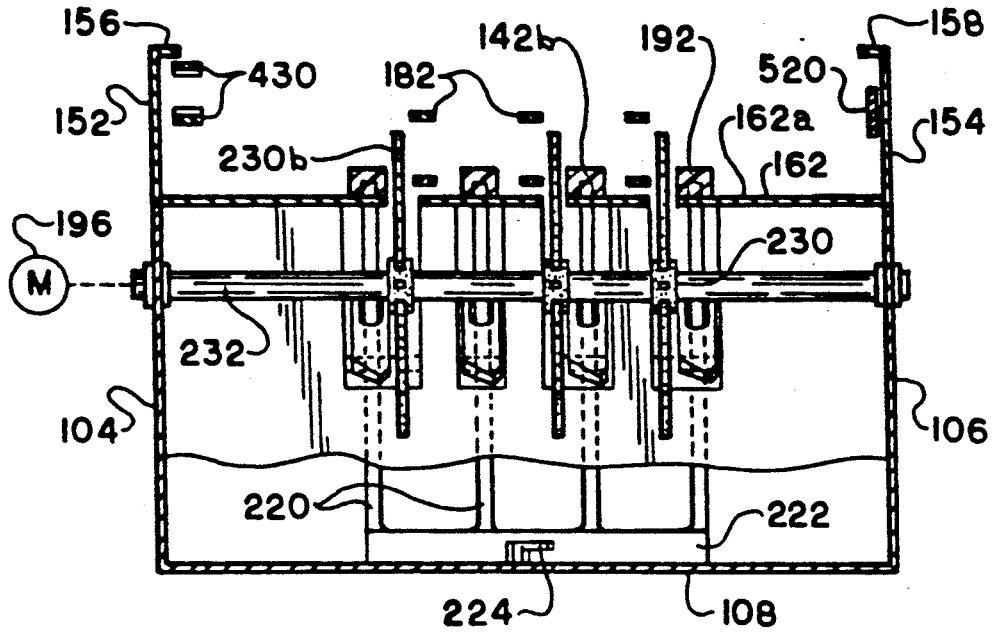
FIG. 10 is a sectional view taken along line 10—10 of FIG. 3.

Stacking assembly 200 also includes a mechanism for aligning notes during stacking. In the embodiment shown, the stacking assembly 200 includes three paddle wheels 230 (best seen in FIG. 7) which are operative to align the individual notes against wall 114 of housing 100. Each paddle wheel 230 is generally comprised of a central hub 230*a* having a bore therethrough. Paddle wheels 230 are mounted on a shaft 232 which extends through chamber 118 of housing 100. A plurality of thin, narrow, radially-spaced belts 230*b* extend outwardly from hub 230*a* to form a paddle wheel configuration as best seen in FIG. 7. Wheels 230 are preferably formed from a neoprene material or other similar material which is pliable and which has a "spongy" or adhering outer surface to adhere or grip sheet material. As seen in FIG. 10, paddle wheels 230 are spaced apart along shaft 232 such that paddle wheels 230 are disposed between belts 182 and rails 142*b*, 192 on wall 112. Slots are provided in walls 112, 114 to enable the radial ends 230*b* of the paddle wheel to extend beyond walls 112, 114 during the rotation of the paddle wheels 230. Paddle wheels 230 are driven by motor 196 via shaft 232. As indicated above, motor 196 also drives belts 182 of horizontal transport 180.

DIVERT ASSEMBLY 300

According to another aspect of the present invention, there is provided a divert assembly 300 to divert individual notes or dump groups of notes from stacking assembly 200 to a designated "divert/dump location". The divert assembly 300 is primarily intended to "divert" double bills (i.e. bills which are stuck together) and prevent such bills from being issued to a customer. In addition, according to the present invention, divert assembly 300 is also used in conjunction with the transfer assembly to "dump" to the designated divert/dump location notes which have been presented to a customer, but which have not been taken by the customer from presenter slot 170.

Divert assembly 300 (best seen in FIGS. 2, 3, and 7) is generally comprised of a divert plate 310 which is slidably mounted for reciprocal movement on flanges 105, 107 of housing 100. Divert plate 310 is generally flat and includes an upper planar surface 310*a*. Divert plate 310 is dimensioned such that surface 310*a* is generally aligned and coplanar with surfaces 112*a*, 162*a*. Divert plate 310 includes four side-by-side parallel rails 312 extending across surface 310*a*. Rails 312 are dimensioned to correspond to and be aligned with rails 216 on stack plate 210, rails 142*b*, 192 on surface 112, and rails 194 on surface 162*a*. In this respect, the upper surfaces of rails 312 are co-planar to path P defined by rails 142*b*, 192, 194, and 216. As shown in the drawings, the ends of rails 312 are angled along the longitudinal axis thereof to conform to and mate with ends of rails 216 on the stack plate 210.

Figure 11:
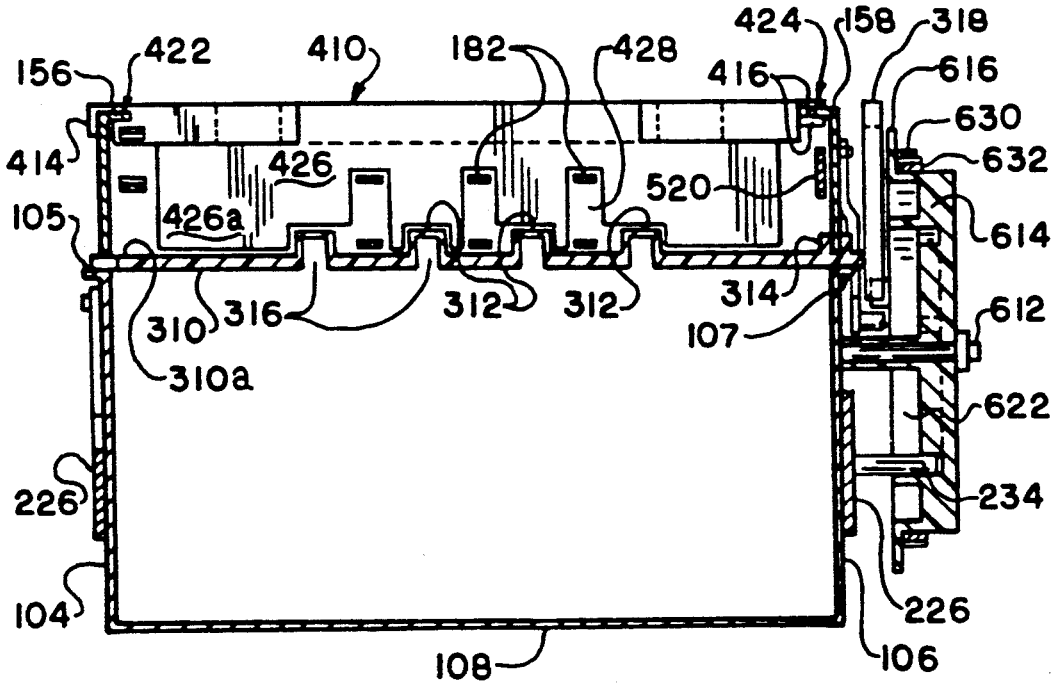
FIG. 11 is a sectional view taken along line 11—11 of FIG. 3.

Divert plate 310 is dimensioned to extend through horizontal slots 165 (best seen in FIG. 8) and rest on flanges 105, 107 of housing 100, as best seen in FIG. 11. One side of divert plate 310 includes a guide 314 (best seen in FIG. 11) which is dimensioned to receive the lower edge of side wall 154 and is operable to maintain divert plate 310 in alignment with frame 150. In this respect, the divert plate is movable between a first position wherein the divert plate 310 is positioned over chamber 122 at one end of the stack plate 210 (as best seen in FIG. 7) to a second position wherein divert plate 310 is positioned above or over chamber 120 and stack plate 210. To permit divert plate 310 to move over tines 220 of media stop 222, stack plate 310 includes elongated grooves 316 formed below rails 312. A vertically oriented, generally rectangular plate 318 is attached to one side of divert plate 310. Plate 318 includes a vertically aligned slot 320 (best seen in FIG. 2) which is dimensioned to operatively engage a control pin on control mechanism 600 as will be discussed in greater detail below.

PUSH PLATE ASSEMBLY 400

Push plate assembly 400 is generally comprised of a push plate 410 and means for reciprocally moving push plate 410 the length of transport module 38. Push plate 410 is generally comprised of a rectangular platform 412 which extends between side walls 152, 154 of transport module 38. As best seen in FIG. 3, one end of 412 includes extensions 414 and the other end includes vertically spaced tabs 416. Extensions 414 define generally L-shaped recesses 422 dimensioned to receive flange 156 and side wall 152, while vertically spaced tabs 416 define a slot 424 to receive flange 158 of side wall 154, as best seen in FIG. 11. Recess 422 and slot 424 are dimensioned to enable platform 412 to slide freely on flanges 156, 158, with extensions 414 maintaining the lateral position of platform 412. A plate 426 extends downward from platform 412. Plate 426 has a planar surface 426*a* which is generally perpendicular to plane P (i.e. the upper surfaces of rails 142*b*, 216, 192, 194, etc.). Plate 426 is dimensioned such that its lower edge is immediately above (i.e. not touching), and can slide freely over surfaces 112*a*, 162*a*, 214*a*, and 310*a*. A plurality of notches 428 are formed in plate 426 to accommodate belts 182 of horizontal transport 180 and the rails on stack plate 210, divert plate 310 and modules 36, 38. A toothed belt 430 is secured to platform 412. Belt 430 is driven by a motor 432 schematically represented in the drawings. Motor 432 is preferably a conventionally-known stepping motor having a speed sensor associated therewith wherein the speed of motor 432 can be controlled and monitored. Motor 432 is mounted to the outer surface of wall 152 (not shown) of frame 150 and includes a shaft 434 extending through wall 152 having a drive sprocket 436 thereon. An idle sprocket 438 is mounted to wall 152 adjacent dispensing slot 170. Sprockets 436, 438 are positioned such that toothed belt 430 is generally parallel to belts 182.

GATE ASSEMBLY 500

Figure 8:
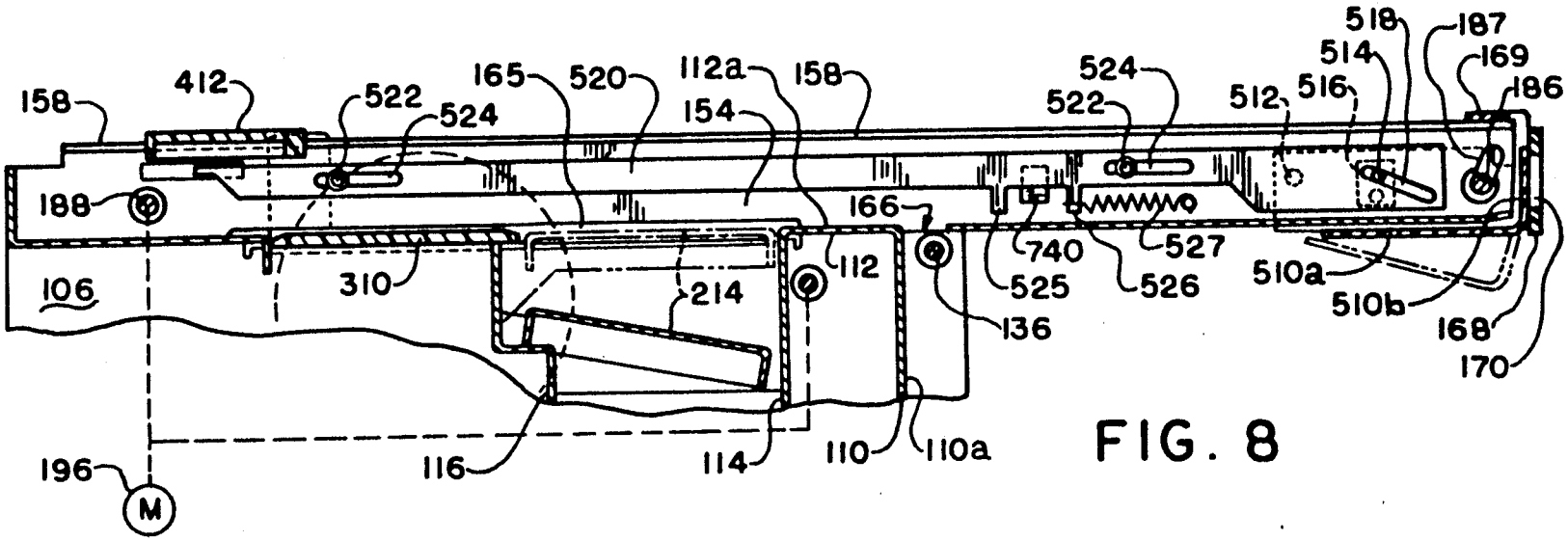
FIG. 8 is a sectional view taken along line 8—8 of FIG. 3.
Figure 9:
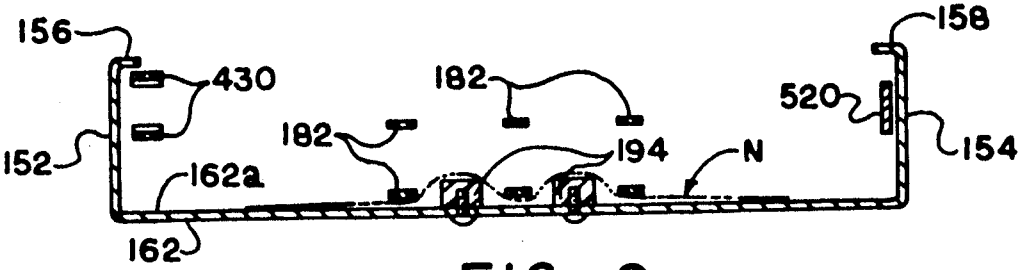
FIG. 9 is a sectional view taken along line 9—9 of FIG. 3.

Gate assembly 500, best seen in FIGS. 2, 3, 7, 8 and 10, includes a box-like gate 510 having a bottom wall 510*a*, one end wall 510*b* which is dimensioned to be received in the space between plate 168 and the ends of side wall 152, 154 of stacking module 38, and two parallel side walls 510*c* dimensioned to be disposed outside side walls 152, 154 of stacking module 38. Gate 510 is pivotally mounted to stacking module 38 by pivot pins 512 extending from side walls 152, 154. The gate side wall 510*c* adjacent side wall 154 of transport module 38 includes a pin 514 which extends through a rectangular opening 516 (shown in phantom in FIG. 8) into a slot 518 at one end of an elongated link 520. As shown in FIG. 8, link 520 is mounted to side wall 154 by pins 522 extending through slots 524 in link 520, such that link 520 has limited longitudinal movement along wall 154. Link 520 includes two downwardly extending fingers 525, 526. Finger 526 is biased by a spring 527 which urges link 520 and gate 510 toward the position shown in FIG. 8 wherein end wall 510*b* is adjacent to and obstructs opening 170 in plate 168.

Referring now to the other end of link 520, a laterally projecting arm 528 extends from link 520 through a rectangular opening 530 in side wall 154. Arm 528 is operatively attached to a generally L-shaped actuating member 532, best seen in FIG. 2. Actuating member 532 is mounted to the outer side of side wall 154 by a pin 534 extending through a slot 536 therein. An outwardly projecting pin 538 (shown in phantom in FIG. 2) is provided at the end of actuating member 532 to operatively engage control mechanism 600 as will be discussed in greater detail below.

CONTROL ASSEMBLY 600

To coordinate the movement and operation of stack plate 210, divert plate 310 and gate 510, control assembly 600 is provided. The control assembly 600 is generally comprised of a control wheel 610 which is mounted for rotation about a fixed axis on an axle 612 (best seen in FIG. 11) which is secured to wall 106 of stack module 36. Control wheel 610 includes a cylindrical portion 614 and flange portion 616. As best seen in FIGS. 13A–13D, cylindrical portion 614 includes an elongated curving slot 618, which opens toward wall 106 of stacking module 36 and extends around axle 612. Slot 618 is comprised of three distinct portions, namely, a first, relatively long concentric portion 618*a* which forms a major portion of slot 618, a shorter second portion 618*b* which spirals inwardly from first portion 618*a* toward axle 612 and a still shorter third portion 618*c* which is concentric about axle 612. Slot 618 has a predetermined configuration which will be more fully understood from the subsequent discussion of the operation of control wheel 610. Slot 618 is dimensioned to received roller pin 234 on arm 226 of stack plate 210 and control pin 538 on actuator member 532 of gate assembly 500. Control wheel 610 also includes an actuating pin 620 extending inwardly from flange portion 616 toward wall 106. Actuating pin 620 is dimensioned to be received within slot 320 of divert plate 310. Control wheel 610 also includes an inwardly extending annular wall 622, best seen in FIG. 11. In this respect, wall 622 is generally concentric to the axis of axle 612 and projects toward side wall 106 of stacking module 36. Associated with control wheel 610 is a stepping motor 624 schematic designated in the drawings. Motor 624 is preferably positioned within the housing 100 of stacking module 36 with a drive shaft 626 extending through wall 106. Shaft 626 includes a tooth drive sprocket 628 for driving a tooth belt 630. Belt 630 is operable to drive a toothed ring 632 (best seen in FIG. 3) which is attached to cylindrical portion 614 of control wheel 610.

COMPUTER PROCESSING UNITS 14, 18

Figure 17:
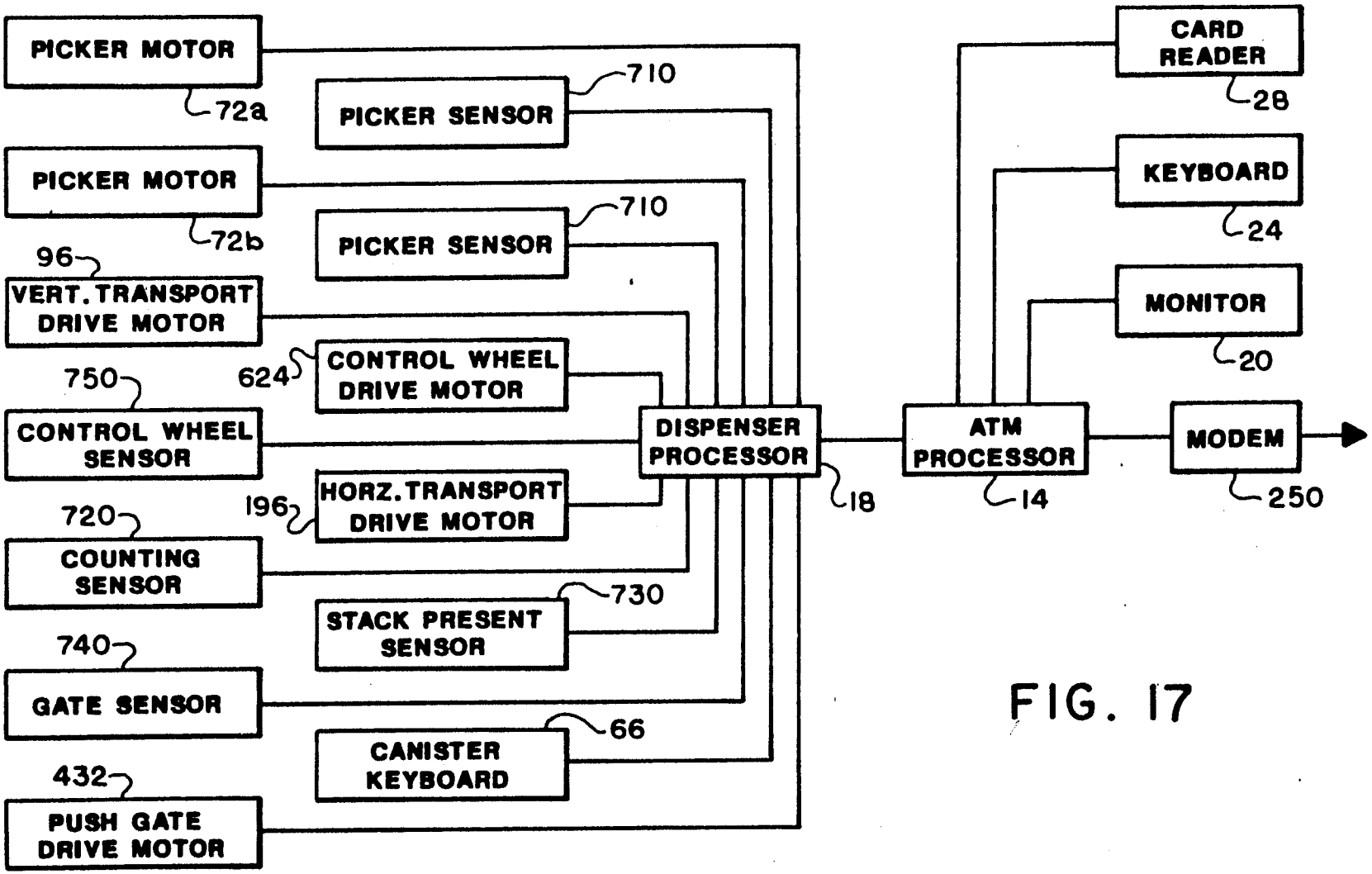

Operations of ATM 10 and multi-media dispenser 16 are controlled by ATM processor 14 and dispenser processor 18 which are schematically illustrated in FIG. 17. In the preferred embodiment of the present invention, ATM processor 14 is operatively associated with card reader 28, monitor 20, screen 22, and keypad 24. Broadly stated, ATM processor 14 monitors and controls two generally separate aspects or functions of ATM 10, i.e. the personal aspects of a transaction (the financial aspects and the customer interface) and providing operational instructions to dispenser processor 18.

With respect to the former, ATM 10 is typically utilized in a media dispensing activity involving a financial transaction, e.g. dispensing currency or purchasing tickets. In this respect, ATM processor 14 is provided to accept information data from a prospective patron or customer, to ascertain from such data possibly in conjunction with a network computer and (together with other data about such prospective customer from a record source) whether the prospective patron or customer has a predetermined status necessary to receive notes (typically withdraw currency) from ATM 10, to record data regarding a withdrawal of notes or currency and to adjust the record data in response to a withdrawal by a customer. In addition, ATM processor 14 is programmed to provide a patron with information regarding features and functions of ATM 10 by means of the video screen 22 and the electronic display 20.

The information data from the patron is generally in the form of a conventionally-known credit card having identification data encoded thereon. The credit card is inserted into card slot 30 to be read by card reader 28 in a conventional manner. The card provides information identifying the cardholder and provides other information with respect to the prospective patrons financial status, which may be in the form of data with respect to financial record files or financial institutions. Such data, utilized together with data from a record file or an external source, determines whether the prospective patron is authorized to utilize ATM 10. In this respect, processor 14 may have an internal record file including the account numbers of all patrons for whom the access machine is allowed, or it may be connectable by a modem 250 (or directly by a dedicated line) to an external record source such as a financial institution or credit authorization service in a manner conventionally-known in automatic bank teller machines. With information from the credit card, together with information from the internal or external record source, ATM processor 14 can determine whether the identified patron has the appropriate status to make a media or currency withdrawal. If authorized, data regarding parameters of the dispensing (i.e. date, time, amount, etc.) are recorded in file storage of ATM processor 14. The financial records of the patron are modified (debited) based on the value of the notes or currency dispensed. With respect to this modification of the financial records, if the records are maintained internally by the machine, such modification can be done by ATM processor 14. If the financial records are external of the machine (at a financial institution or credit authorization service), information regarding withdrawal transaction are transferred to such external records from ATM processor 14. As set forth above, communications with the external records may be accomplished by modem 250, as shown by FIG. 17 or directly by a dedicated line (not shown). With the modem arrangement, information concerning several transactions may be stored in file storage of processor 14 throughout the day and then transferred to the external records at one time, thereby saving on transmission and hook-up costs. ATM processor 14 may also include printer means (not physically shown) providing patrons with a records of all transactions.

Thus, with respect to the financial and customer interface aspects of the present invention, ATM processor 14 basically provides a means for identifying patrons, means for communicating with the patrons, means for checking a patron's financial status, means for monitoring the withdrawal transaction, and means for means for modifying a patron's financial records.

Referring now to the operational function of ATM processor 14, processor 14, based on information from a customer, basically instructs dispenser processor 18 as to the number of notes to be dispensed and the number of notes to be dispensed from each canister (in the event canister 50 holds different types of notes).

Figure 13A:
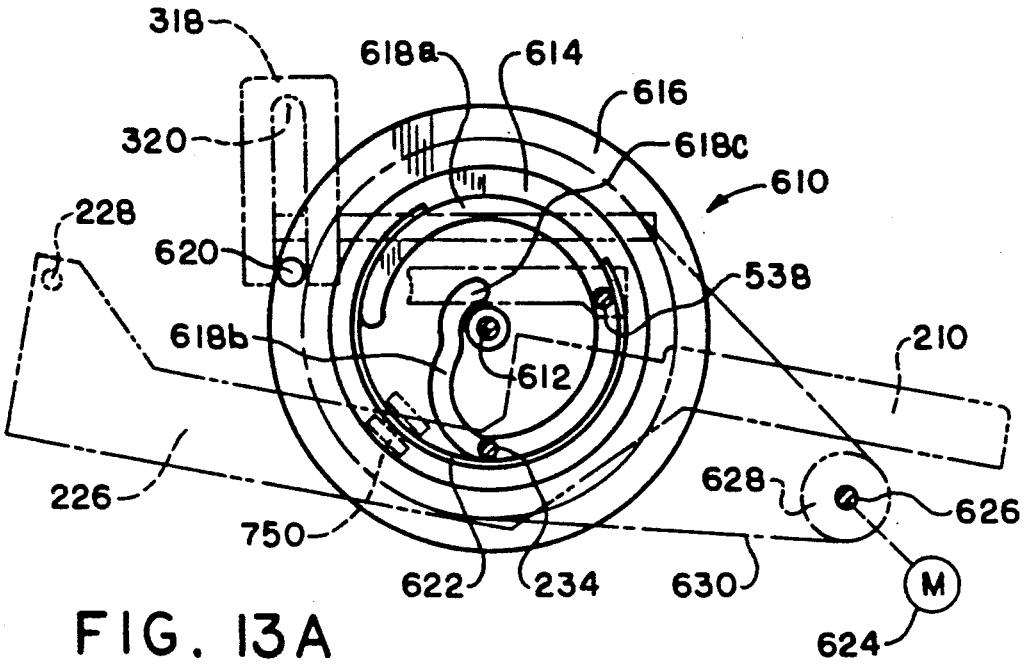
FIG. 13A is a sectional view taken along line 13—13 of FIG. 3 showing a control wheel according to a preferred embodiment of the present invention, wherein the control wheel is in a first position and a stacking plate (shown in phantom) is in a stacking position and a divert plate in a normal position.
Figure 13B:
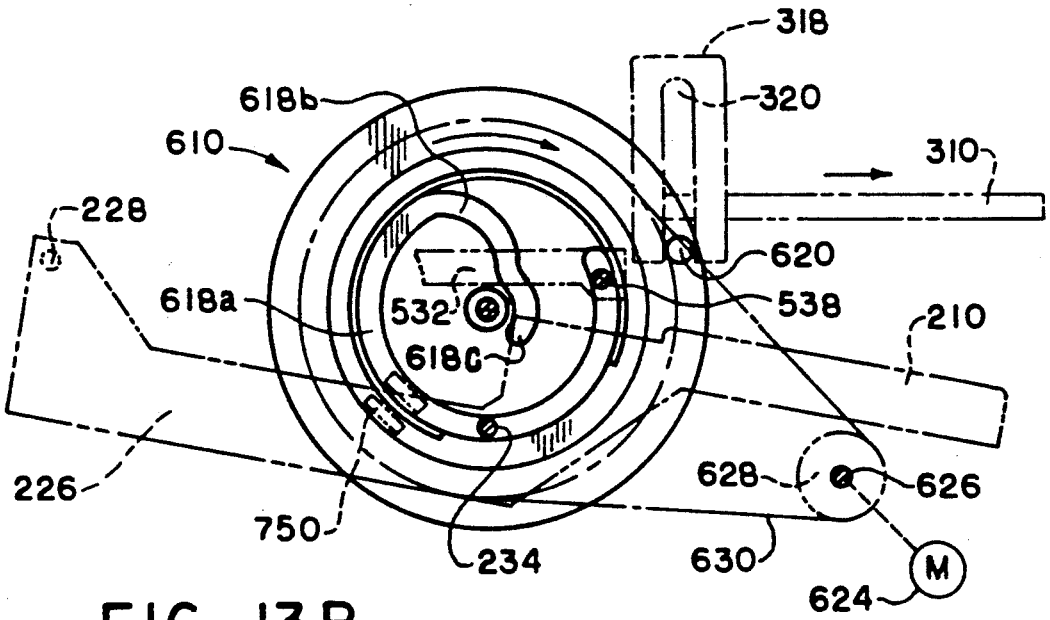
FIG. 13B is a sectional view of the control wheel shown in FIG. 13A showing the control wheel in a second position wherein the stacking plate is in a stacking position and the divert plate is in a currency diverting position.

Referring now to dispenser processor 18, as schematically illustrated in FIG. 17, processor 18 basically controls and monitors the operation of picker mechanisms 60, vertical transports 80 and 130, horizontal transport 180, stacking assembly 200, divert assembly 300, push plate assembly 400, gate assembly 500, and control assembly 600. These components are controlled via picker motors 72a, 72b, vertical transports drive motor 96, horizontal transport drive motor 196, push plate drive motor 432, and control wheel drive motor 624. As indicated above, motors 72a, 72b, 96, 196, 432, and 624 include sensing means (not shown) wherein dispenser processor 18 can monitor the relative position of components associated therewith. In addition to these sensing means, media dispenser 16 includes several other sensors. Referring now to FIG. 5, sensors 710 are disposed below each picker mechanism 60. Sensors 710 are of a type disclosed in U.S. Pat. No. 4,664,369 (which is owned by the assignee of the present application) and are operative to sense the thickness of notes being transferred thereover. The teachings of U.S. Pat. No. 4,664,369 are hereby incorporated by reference into present application. Sensors 710 monitor notes picked by mechanisms 60 and to ensure doubles, (i.e. notes which may be stuck together) are not dispensed to a customer. A counting sensor 720 is provided in the upper surface of leg portion 142b of L-shaped rail 142 (best seen in FIG. 3) to count notes which pass thereover as they move to stacking assembly 200. A exit sensor 730 is provided in the upper surface of rail 194 to sense the position of a stack of notes being presented to a customer through slot 170. A gate sensor 740 (best seen in FIG. 8) is provided on side wall 154 in operative relation to finger 525 to monitor the positions of gate 510. A control wheel sensor 750 (shown in phantom in FIGS. 13A–13D) is provided to monitor the positions of control wheel 610. Sensor 750 is generally U-shaped and is disposed such that wall 622 is disposed between the legs thereof. Sensor 750 is operable to sense notches and windows (not shown) formed at predetermined positions in wall 622. The notches and windows correspond specific important operational positions of control wheel 610. The important operational position of control wheel 610 are illustrated in FIGS. 13A–13B and will be discussed in greater detail below.

In addition to sensors 710, 720, 730, 740, and 750, dispenser processor receives information from keyboard 66. Keyboard 66 provides information which identifies the particular canister 50 inserted into multimedia dispenser 16, but more importantly, it also identifies the type of media (notes currency, etc.) within canister 50, the height of the notes, and the thickness of the note contained therein. Information from keyboard 66 is communicated by dispenser processor 18 to ATM processor 14.

TRANSPORTS 80, 130, 180

Referring more specifically to vertical transport 80, 130, and horizontal transport 180, each is basically comprised of a plurality of side-by-side, parallel belts juxtaposed with a plurality of side-by-side parallel rails. The belts and rails are aligned and extend in the same direction. As best illustrated in FIG. 6, the rails are interjacent the belts and spaced a predetermined distance therefrom. The rails basically define elevated surfaces which generally lie in a common plane and define the path along which the notes are conveyed. In each transport, the operative frictional surface of the belts are disposed below the plane defined by the elevated rail surface in the space defined therebetween. In this respect, the belts and rails mesh and interact to provide an undulated or corrugated passage therebetween. Specifically, notes disposed between the belts and the rails preferably engage the belts sufficiently to maintain frictional engagement therewith and to be motionless relative thereto as the belts move between the rails. In this respect, the elevated surfaces are preferably smooth to allow the notes to freely slide thereover.

As best seen in FIGS. 4–6, the rails of vertical transport 80, 130 are tapered along their longitudinal and lateral edges. The rails of horizontal transport 180 (including the rail on stack plate 210 and divert plate 310) while having tapered and angled longitudinal edges are generally rectangular in cross-section (best seen in FIGS. 10 and 11). Moreover, the rails of horizontal transport 180 are slightly higher (elevated) than those on vertical transports 80, 130. These differences are basically due to the function of each transport.

In this respect, vertical transports 80, 130 are provided to transport single notes in a vertical direction, as best illustrated in FIG. 4. For such an operation, it is basically only necessary that successive rails be aligned and that the upper surface of the rails lie in a common plane. As seen in FIG. 4, the configuration of the successive rails, as well as the belts, may vary so long as the rails and belts are aligned and are operable to convey a note. Horizontal transport 180 on the other hand is provided to convey a stack of notes (as well as single notes) in conjunction with push plate 410. In this respect, to ensure close cooperation between push plate 410 and the respective rails, the lateral edges of the rail are squared to match the squared corners of the notches provided in push plate 410. Moreover, the rails of horizontal transport 180 are higher to enable push plate 410 to extend below the upper surface of the rails a distance sufficient to ensure that no notes will pass or be wedged under the bottom edge of push plate 410 during operation.

Accordingly, the height and cross-sectional configuration of the rails in and of themselves are not critical to the present invention. It is only important that the rails and belts be aligned and juxtaposed in operative relation to another to form an undulated passage therebetween (i.e. the frictional surface of the belts is below the elevated surface of the rails) and are operable to maintain frictional engagement between the belts and the notes to be conveyed. It will also be appreciated that the lateral spacing between adjacent rails and belt may vary depending on the sheet media to be conveyed, and that the number of belts and rails may vary. In each of the transports shown, three belts and two rails are provided. In this respect, it is believed at least two rails are necessary to maintain alignment of the notes. In the embodiment shown, additional rails are shown on stack plate 210 and divert 310. It has been found that additional rails on these members facilitates better stacking by supporting the lateral ends of the notes and that such support assists in ensuring proper engagement between a stack of notes and push plate 410. In the embodiment shown, belts 82, 132 of vertical transports 80, 130 are of an un-reinforced urethane, belts 182 of horizontal transport 180 are formed of nylon reinforced, semi-stretch neoprene.

OPERATION

Referring now to the operation of ATM 10, media canisters 50 are inserted into multi-media dispenser 16 as shown in FIG. 5. Pins 68 on canister 50 are positioned to engage specific switches 67 on keyboard 66. In the embodiment shown, actuation of the preselected switches 67 identifies to dispenser processor 18: (1) the specific canister 50 (identification code) being inserted into the machine; (2) the media (notes) contained within the canister 50; (3) the thickness of the notes; and, (4) the height of the notes. This information is communicated to ATM processor 14 by dispenser processor 18. In the embodiment shown, two canisters 50 may be utilized. Importantly, according to the present invention each canister 50 may contain a different type of note. For example, canisters 50 may contain the same type of currency but each canister 50 having a different denomination. In another respect, one canister 50 may contain currency of a particular size and thickness and the other may contain coupons having a completely different size and thickness. In other words, media dispenser 16 is operational with two dissimilar types of notes.

The following discussion of the use and operation of ATM 10 is based upon a dispensing transaction involving financial value wherein a patron or customer must meet a predetermined status. It will, of course, be appreciated that ATM 10 and media dispenser 18 may be programmed to operate merely upon request by any individual.

Use of a ATM 10 is initiated by a customer inserting a conventionally-known credit card into card slot 30. The card, which is read by cardreader 28, provides information identifying the cardholder and provides other information with respect to the prospective patron's financial status. If the media contained within the ATM 10 has value, typically an approval of the customer's financial status is required. ATM processor 14 may have an internal record file including the account numbers of all patrons for whom access to the machine is allowed, or ATM processor 14 may connect via modem 250 or dedicated line (not shown) to an external record source such as a financial institution or credit authorization service to check the status of the customer. In a conventionally-known manner, ATM processor 14 can advise the customer via screen 22 of monitor 20 whether access to the machine is allowed and provide instructions as to procedures for the customer to follow to receive notes from ATM 10. The transaction is conducted by the customer entering pertinent information (in response to prompts by ATM processor 14) using operation keys 26 on keypad 24. When the pertinent information has been entered and processed, processor 14 will instruct dispenser processor 18 as to the number of notes to be dispensed from canister 50.

Having received instructions form ATM processor 14 with respect to the number of notes to be dispensed, dispenser processor 18 initiates dispensing of the notes in a predetermined sequence.

Figure 14A:
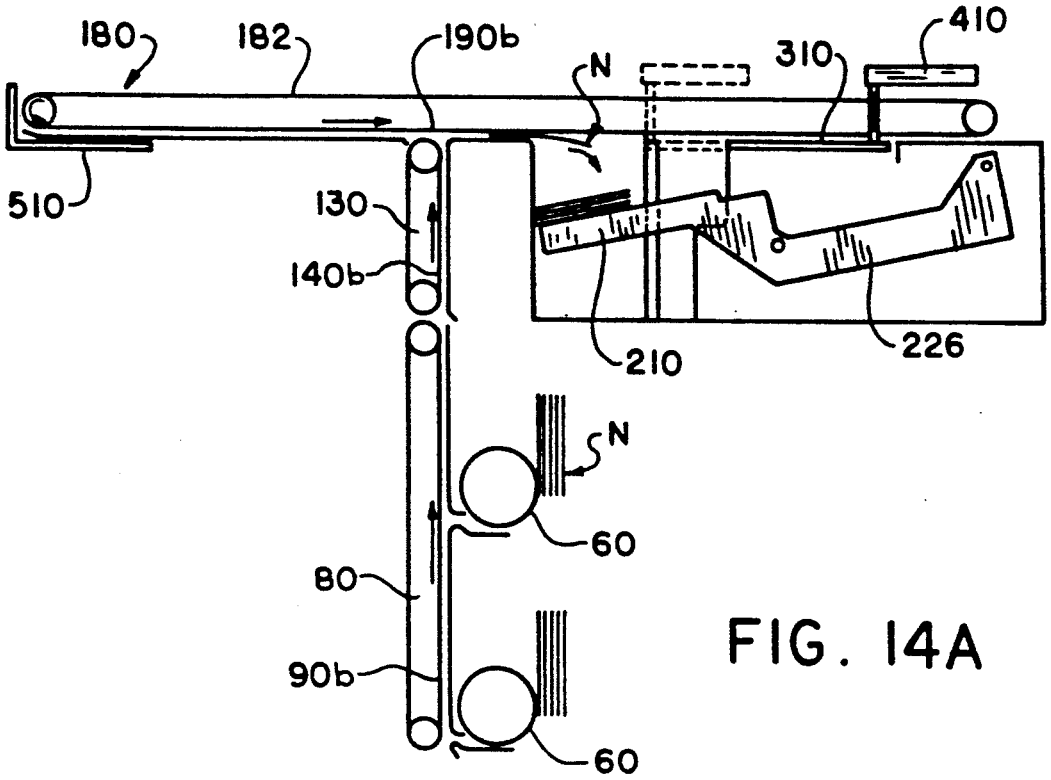
FIGS. 14A–14D are a representative view of the media dispensing mechanism according to the present invention at various stages of operation.
Figure 14B:
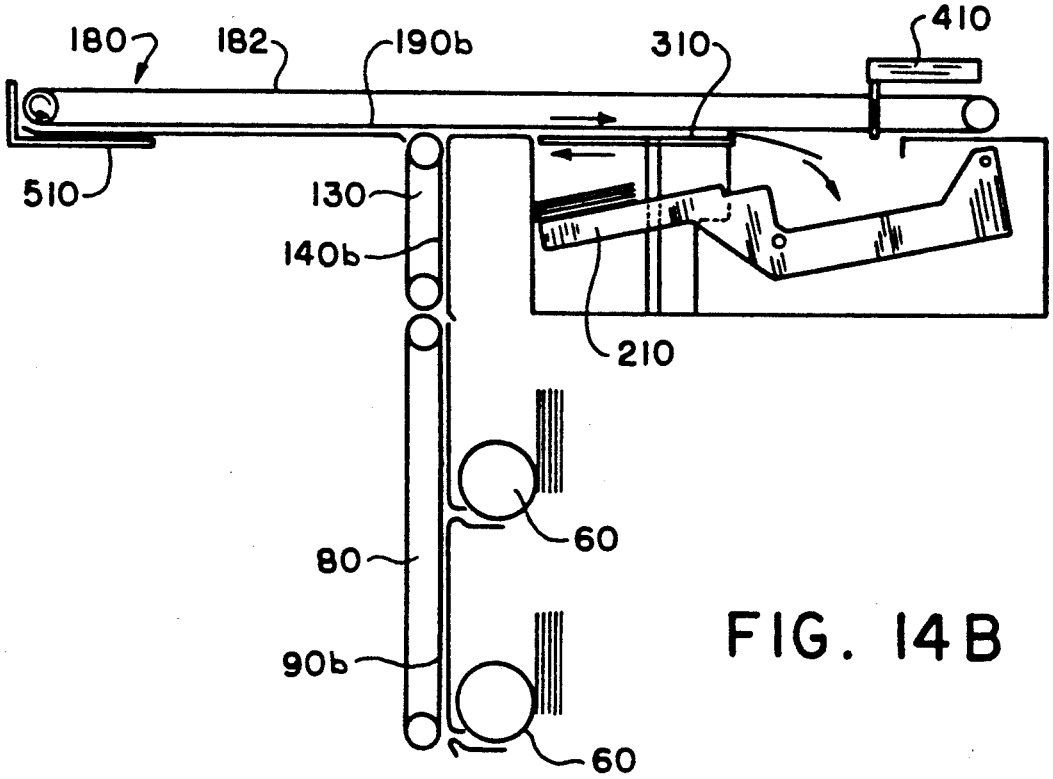

FIG. 14A shows general positions of the respective components of media dispenser 16 when dispensing of notes is initiated. As indicated above, control wheel 610 coordinates the operation of stack plate 210, divert plate 310 and gate 510. In this respect, FIG. 13A shows generally the position of control wheel 610 to locate the operative components, i.e. stacking plate 210, divert plate 310, push plate 410, and gate 510, to the positions shown in FIG. 14A. FIG. 13A shows control wheel 610 in a first position, wherein pin 234 which is associated with stacking plate 210 and pin 538 which is associated with gate 510 are disposed within slot portion 618*a* of cam slot 618. Actuating pin 620 is disposed at the bottom of slot 320 of divert plate 310. With control wheel 610 in this position, stack plate 210 is in a first position disposed below and away from belts 182 of horizontal transport 180, divert plate 310 is a position shown in FIG. 14A, and gate 510 is in a normal, closed position. Push plate 410 which is independently controlled by dispenser processor 18 via motor 432 is positioned in a rearmost location as shown in FIG. 14B. Media stop 222 is preferably fixedly positioned within media dispenser 16 to a position which will accommodate the largest media expected to be used in media dispenser 16. According to the preferred operation of the present invention, divert plate 310 and push plate 410 are repositioned by dispenser processor 18 prior to dispensing to predetermined positions relative to stack plate 210 as shown in phantom in FIG. 14A. These positions are determined by dispenser processor 18 based upon the height of the note to be dispensed, which information was provided by keyboard 66. Push plate 410 is repositioned by dispenser processor 18 by means of motor 432. Divert plate 310 is repositioned by dispenser processor 18 by rotating control wheel 610 by motor 624. Control wheel 610 as viewed in FIG. 13A would be rotated clockwise a predetermined angle from the position shown. The amount of rotation being calculated and monitored by dispenser processor 18 via information from stepping motor 624 and the positional sensor therewith (not shown) and sensor 750. The rotation of control wheel 610 causes actuating pin 620 to move along an arcuate path to the right as seen in FIG. 13A, wherein actuating pin 620 moving through vertical slot 320 causes divert plate 310 to move to the right in FIG. 13A (to the left in FIG. 14A).

Figure 12A:
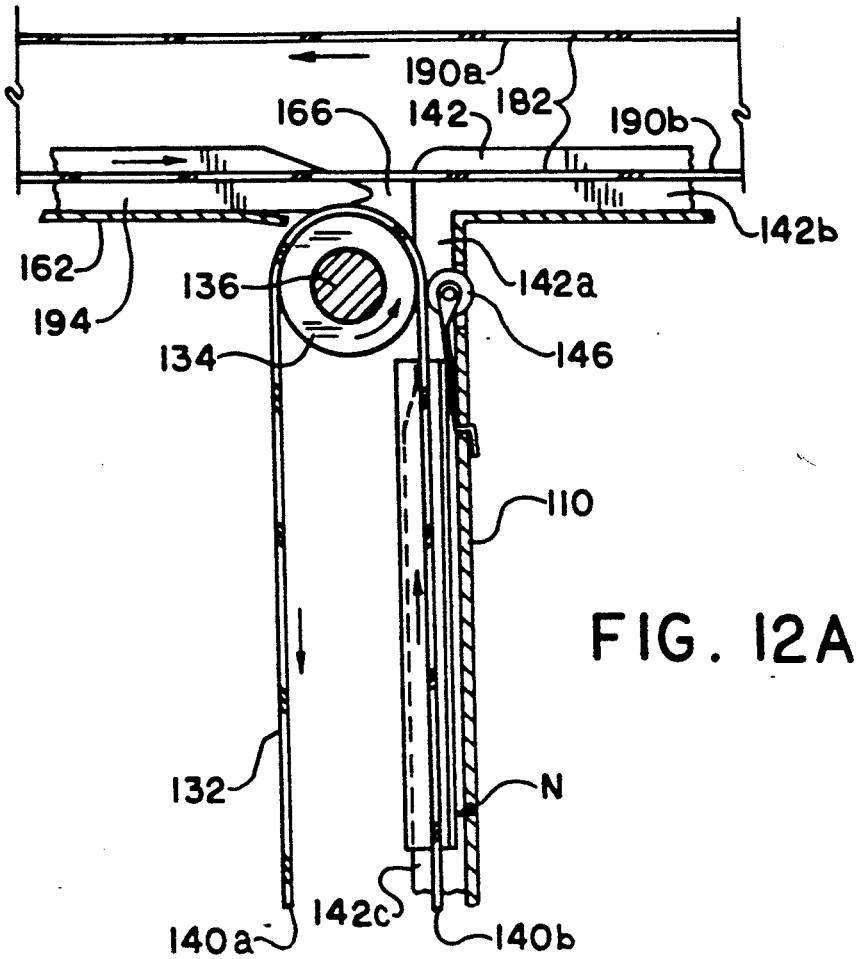
FIG. 12A is an enlarged sectional view taken along line **12*a*—12*a* of FIG. 3** showing a note being transferred from a vertical transport to a horizontal transport.
Figure 12B:
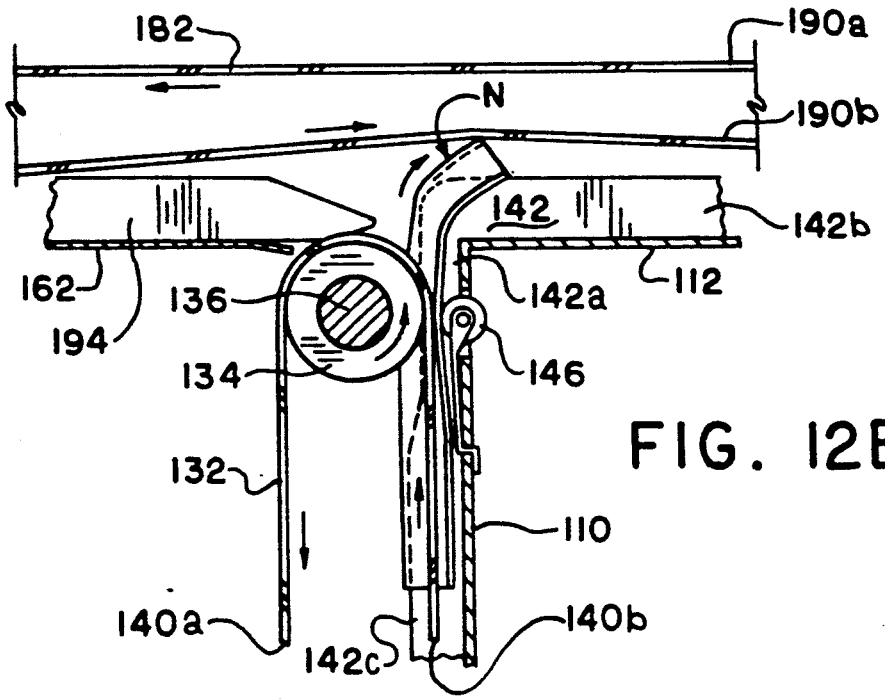
FIG. 12B is an enlarged sectional view showing an individual note engaging conveyor belt of the horizontal transport.

Dispenser processor 18 initiates vertical transport motor 96 and horizontal transport motor 196 such that belts 82 of vertical transport 80, belts 132 of vertical transport 130 and belts 182 of horizontal transport 180 move in the direction shown in FIG. 14A. Dispenser processor 18 then initiates picker mechanisms 60 in sequence to pick individual notes from canisters 50. If media dispenser 16 contains notes of different sizes, dispenser processor 18 is programmed such that the largest note is dispensed first. In this respect, an individual note is picked by pad 62*a* of roller 62 which feeds the note toward flight 90*b* of belts 82 of vertical transport 80. The individual note passes over thickness sensor 710 which scans the thickness to ensure that a single note is being transferred. Sensor 710 has been programmed by processor 18 to monitor a predetermined thickness. In this respect, the programmed thickness is determined by the information provided to processor 18 and ATM processor 14 by switches 67 on keyboard 66. The individual note engages flight 90*b* of belts 82 which bend the note upward, the note being trapped in undulated passage 94 between the belts 82 and rails 92. In this respect, the outer frictional surface of the belts 82 force the note along rails 92. The note is driven to vertical transport 130 wherein belts 132 force the note along L-shaped rails 142 toward horizontal transport 180. As best seen in FIGS. 12A, 12B, belt 132 forces the note between pinch roller 146 and roller 134. Pinch roller 146 produces a "hard drive" to force the note upward under a positive friction. This "hard drive" forces the leading edge of the note into flight 190*b* of belts 182 of horizontal transport 180, as best seen in FIG. 12B.

The leading edge of the note generally causes flight 190*b* of belts 182 to deflect upward as belts 182 pull the leading edge of the note in the direction of the moving belt. The amount of deflection depends on the thickness and rigidity of the note being transferred. Importantly, this resilient feature enables dispenser 18 to transfer rigid cards as well as pliable currency. Notes transferred to horizontal transport 180 are confined between belts 182 and the upper surfaces of leg portions 142*b* of L-shaped rails 142 and supplemental rails 192. The frictional outer surface of belts 182 drives the note along rails 142, 192. Note N is driven horizontally by horizontal transport 180 until it is positioned above stacking plate 210. As the horizontal movement of the note brings it to a position above stack plate 210, belts 230*b* of paddle wheels 230 catch the upper surface of the note and force it downward onto stack plate 210. Movement of the flexible belts 230*b* across the upper surface of the note, also draw the note against transverse wall 114 to align the leading edges thereof. Importantly, as indicated above, divert plate 310 and push plate 410 are positioned prior to the stacking sequence to generally align with tines 220 of media stop 222 as schematically represented in FIG. 14A. In this respect, media stop 222, divert plate 310, and push plate 410 provide a positive barrier to prevent the notes from being transferred beyond the stacking position. Counting sensor 720 on leg portion 142*b* of L-shaped rail 142 counts the individual notes as they pass thereover to insure that the correct number of notes have been picked by picker assembly 60 and transferred to stack plate 210.

If a second type or denomination of note, possibly a smaller note, is to be dispensed, such notes are transferred in a similar manner from their respective canister 50. Importantly, during the stacking of the smaller notes, divert plate 310 and push plate 410 are repositioned by dispenser processor 18, i.e. moved horizontally to the left, a predetermined amount to provide a barrier for the smaller note. Again, the position of divert plate 310 and push plate 410 is calculated by dispenser processor 18 based upon the information received with respect to the height of the smaller note. The smaller media is then stacked upon the larger media in a manner previously described wherein the edges of both notes (i.e. the larger and smaller) are aligned by paddle wheels 230 against transverse wall 114.

During the picking of the notes from canisters 50, some notes may have a tendency to stick together wherein double bills may be detected by sensor 710. In such an event, dispenser processor 18 reverses direction of the picker roller 62 in an attempt to separate the double bills. If the double bill cannot be separated by repeated reversing of picker roller 62, media dispenser 16 is operable to divert the double to a "divert/pump location" located in compartment 122 of stacking module 36. To accomplish "dumping" or "diverting" of notes, divert plate 310 is moved to the left to a position above stack plate 210 as schematically illustrated in FIG. 14B. Movement of divert plate 310 is initiated by control wheel 610 as shown in FIG. 13B. In this respect, to move divert plate 310 to the position schematically illustrated in FIG. 14B, control wheel 610 is rotated by motor 624 in a clockwise direction as viewed in FIG. 13B. In this respect, actuating pin 620 moves divert plate 310 to the right (as seen in FIG. 13B) by moving through slot 320 of rectangular plate 318 in a manner as discussed above. The positions of stack plate 210 and gate 510 remain the same as pins 234 and 538 move through slot portion 618*c* which is generally concentric about axle 612. The double bills are conveyed by vertical transports 80, 130 to horizontal transport 180. Belts 182 drive the "doubles" over rails 312 of divert plate 310 into chamber 122 of stacking module 36. The diverted notes are monitored by dispenser processor 18 and ATM processor 14. A divert/dump canister having a similar keyboard type of arrangement may be provided in chamber 122 wherein the specific canister and the amount of currency dumped therein can be monitored. After the double bill has been diverted, control wheel 610 causes divert plate 310 to return to a stacking position generally shown in FIG. 14A, wherein further stacking of notes, monitored by dispenser processor 18, can be conducted until the appropriate number and type of notes are stacked.

Figure 13C:
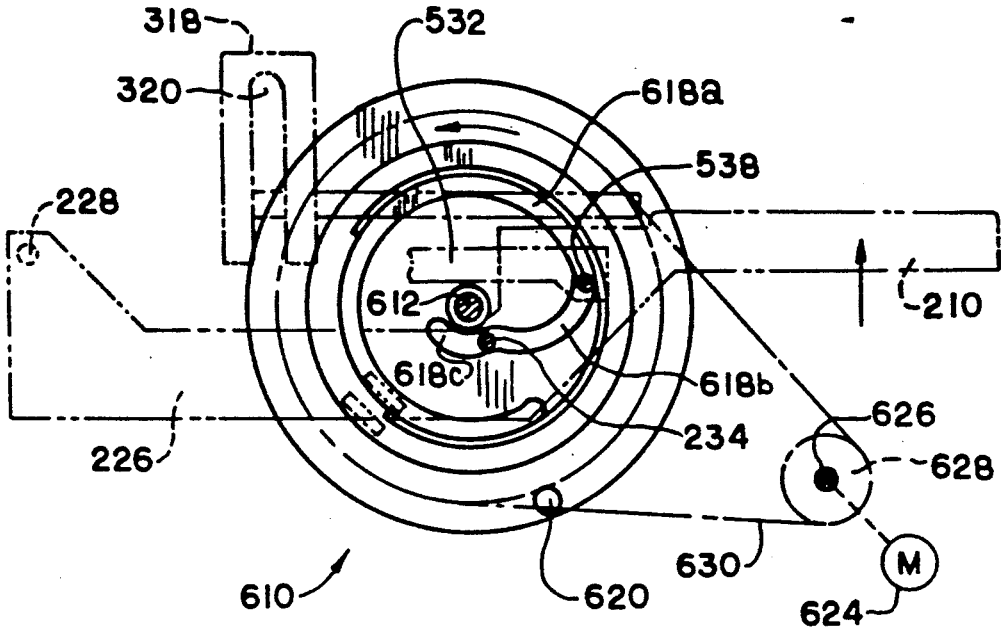
FIG. 13C is a view of the control wheel shown in FIG. 13A showing the control wheel in a third position wherein the stacking plate is in a currency transfer position.
Figure 14C:
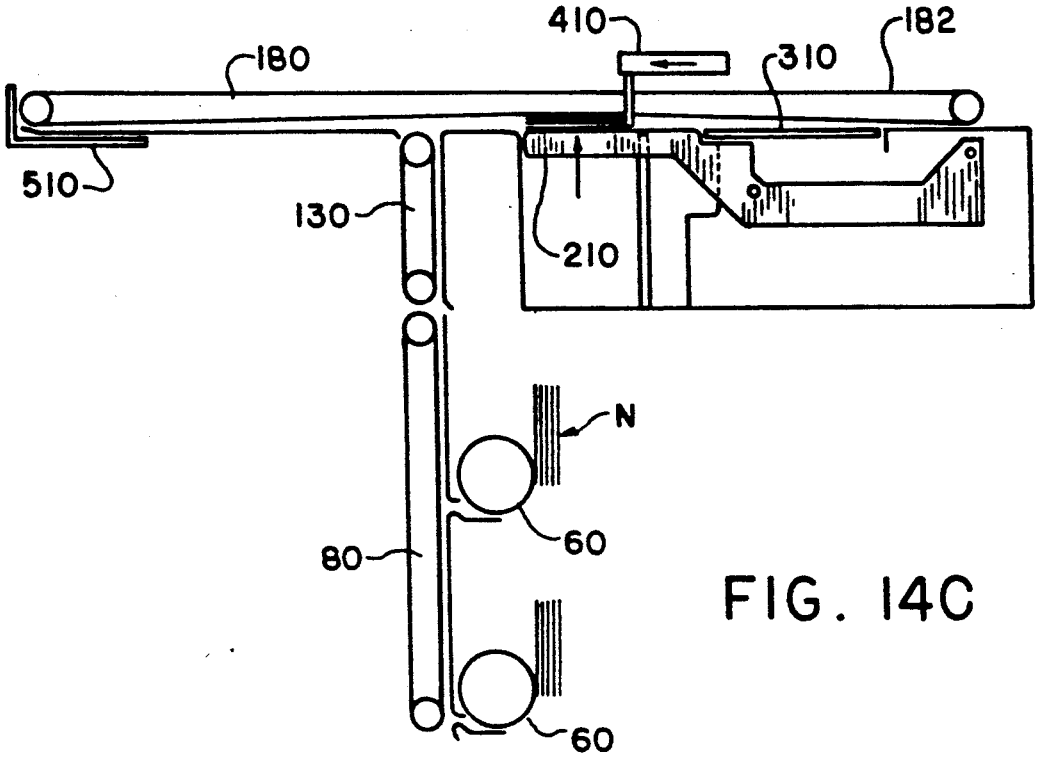
Figure 14D:
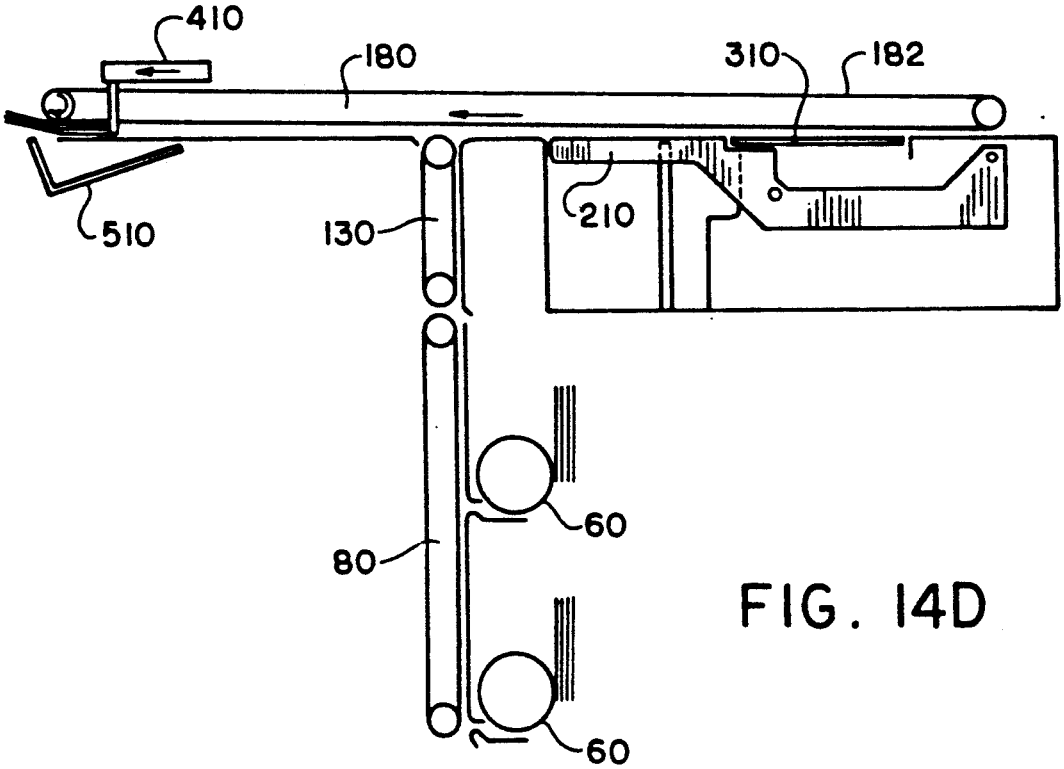

Upon completion of the stacking of the notes to be dispensed, push plate 410 is moved back to clear stack plate 210 and stack plate 210 is moved from its first stacking position to a second elevated position, as schematically illustrated in FIG. 14C, wherein rails 216 are aligned with rails 142, 192, 194 and in operative engagement with belts 182 of horizontal transport 180. Such movement is initiated by dispenser processor 18 which causes control wheel 610 to rotate in a counterclockwise direction to a position as illustrated in FIG. 13C. As shown in FIG. 13C, divert plate 310 has been moved to its rear most position by actuating pin 620 which upon further rotation of control wheel 610 in a counterclockwise position rotates away from slot 320. The counterclockwise rotation of control wheel 610 causes pin 234 on arm 226 to move from its initial position in cam slot portion 618*a* through cam portion 618*b*, which urges pin 234 toward axle 612 causing arm 226 to pivot about pin 234 and to bring stack plate 210 into alignment with the operative plane P.

With stack plate 210 in the position shown in FIG. 14C, push plate 410 is initiated by dispenser processor 18 to drive the stack of notes toward gate assembly 500. Simultaneously, belts 182 of horizontal transport are driven such that flight 190*b* moves toward gate assembly 500. According to a preferred method of operation of the present invention, if the stack of notes to be presented are all the same, push plate 410 is driven at a rate faster than belts 182 of horizontal transport 180. If the stack contains notes of two separate sizes, both sizes being aligned along their leading edges, dispenser processor 18 preferably causes belts 182 of horizontal transport 180 and push plate 410 to be driven simultaneously at the same speed such that relative movements of the smaller notes relative to the larger notes does not occur.

Figure 13D:
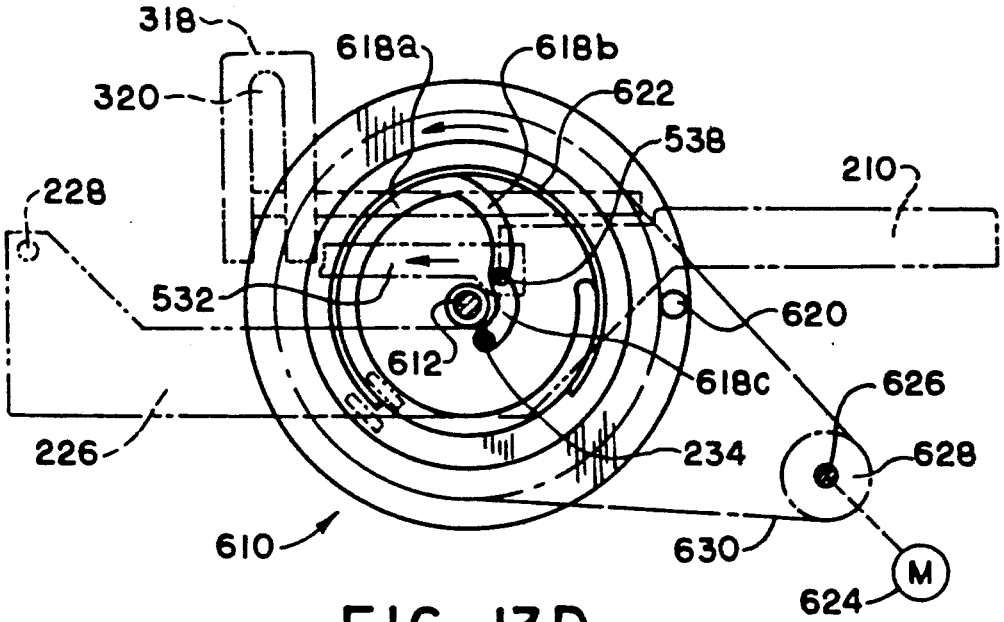
FIG. 13D is a view of the control wheel shown in FIG. 13A showing the control wheel in a fourth position wherein a gate controller arm is being activated.

As the stack of notes is moved toward gate assembly 500, the leading edge of the stack encounters exit sensor 730 on rail 194. Upon exit sensor 730 sensing the leading edge of the stack, dispenser processor 18 causes control wheel 610 to rotate further in a counterclockwise direction to the position shown in FIG. 13D. Such rotation causes pin 538 to move through cam slot portion 618*b* which forces pin 538 toward axle 612. This movement forces actuating member 532 to the left as shown in FIG. 13D. Referring now to FIG. 8, the aforementioned movement of actuating member 532 causes link 520, as shown in FIG. 8, to move to the left. Slot 518 on link 520 causes pin 514 on gate member 510 to move downward to the position shown in phantom FIG. 8 wherein gate 510 is moved down, away from slot 170. Dispenser processor 18 then causes push plate 410 to move the stack of notes a predetermined distance through slot 170 to be accessible to the customer. The "predetermined distance" is based upon the size parameters of the note as indicated by switches 67 on keyboard 66. Slots 187 in side walls 152, 154 enable shaft 186 and belts 182 to move upward to accommodate large stacks of notes. The customer may then take the notes presented through slot 170 which is generally aligned with dispensing opening 32 in housing 12. When the notes are removed by the customer, exit sensor 730 indicates the absence of the notes. Processor 18 then causes control wheel 610 to return to the position shown in FIG. 13C wherein spring 527 acting on finger 526 (best seen in FIG. 8) forces link 520 to return gate 510 to a closed position. Gate sensor 740 which generally monitors the position of finger 525 on link 520 indicates when gate 510 has assumed a closed position. Push plate 410 then returns to its normal home position.

In the event, that the stack of notes presented is not taken by the customer, dispenser processor 18 causes push plate 410 to move back a predetermined distance and belts 182 of horizontal transport 180 to reverse direction to move the stack of notes away from gate 510. Exit sensor 730 indicates when all the notes have been moved away from slot 170. Control wheel 610 is then actuated, as discussed above, to close gate 510. Processor 18 then rotates control wheel 610 to the position shown in FIG. 13B wherein divert plate 310 is positioned over stacking plate 210. Push plate 410 is moved back to a home position, and belts 182 of horizontal transport 180 are actuated to transfer the untaken notes to the "divert/dump location" in chamber 122 of stacking module 36. Information regarding the untaken notes is communicated to ATM processor 14 via dispenser processor 18. Upon completion of the transaction, ATM processor 14 may provide a customer with a printed summary of the transaction via a printer (not shown).

As can be appreciated from the foregoing description, the present invention provides a media handling and feeding device which is relatively simple in design and operation, yet which provides several considerable advantages over media dispensing devices known heretofore. In this respect, as indicated above, prior transfer assemblies generally included moving elements which are in operative engagement with other moving elements, i.e. roller-to-roller or belt-to-belt. Such interaction inevitably produces wear among such elements, which wear can effect the overall operation of the device. Unlike these prior devices, a transport according to the present invention has no surface-to-surface interaction in that, as indicated above, notes are transported through a space defined between moving belts and stationary rails. Thus, no surfaces interact or rub against each or which can cause wear or create static electricity. Moreover, such a transport system requires substantially less power than prior belt or roller systems.

More importantly, however, it is the manner in which the notes are transferred. Because of the space between the belts and the rail surfaces, only slight frictional forces are exerted on each note. In other words, a transport according to the present invention produces a relatively low driving force on the notes. While such force is sufficient to convey notes along the rail surfaces, it is insufficient to pull the notes from components exerting a greater frictional force thereon or to retard the motion of the note when engaging a component exerting a greater force thereon. For example, in the embodiment shown, picker assemblies 60 are provided to pick individual notes from canisters 50. As indicated, occasionally bills will stick together to produce doubles, in which case the direction of rotation of picker roller 62 is repeatedly reversed in an attempt to separate the double bills. During such an operation, a portion of the "double" may be disposed within vertical transport 30 between belts 82 and rails 92. According to the present invention, the relatively low frictional driving force exerted by belts 82 on the notes are insufficient to pull it from picker assembly 60. In this respect, only when a note or "double" is released by mechanism 60 will belts 82 be able to convey such note or double along rails 92. Important, in this respect, is that the speed of belt 82 need not be timed to cooperate with roller 62 of picker assembly 60, and is therefore not limited by the speed of picker assembly 60. Consequently, belt 82 may move at a much greater speed than picker roller 62. In similar respects, belt 182 of horizontal transport may move at a different speed then belts 82. Accordingly, the present invention provides a means of transporting notes which does not require exact timing between respective components.

Still further, the present invention provides a transport wherein the direction of movement of the notes may be changed without the requirement of physical guides which typically are sites where jamming problems occur. In this respect, as best seen in FIGS. 12A and 12B, the direction of note N is changed through its engagement with a moving belt. No physical or structural guides are required to change the direction of the note. The driving force of one transport and the transverse motion of belts cause the note to change direction in a simple highly-efficient, reliable manner.

Each of these features is basically the result of a unique transport mechanism according to the present invention which enables a note to be transferred without speed synchronization between the respective transports, without physical guides to direct the note from one transport to another, and without the need of surface contacting components. Importantly, a transport according to the present invention facilitates simplification of other mechanisms normally associated with media transfer devices. In this respect, a divert assembly according to the present invention provides a sheet media dispensing device wherein individual sheets may be diverted from a stacking mechanism during a stacking operation. Typically, devices known heretofore would be required to "dump" a partial stack if a bad bill (e.g. a "double") was introduced into the system. According to the present invention, such a bill could be "diverted" from the stacking operation without interfering with the partially completed stack. This is accomplished using a divert assembly which is also operable to "dump" entire stacks of notes (in the event the stack is not taken by a customer). The present invention thus provides a media transport and handling device which is simpler in design and operation and has operational advantages over systems known heretofore.

Figure 15:
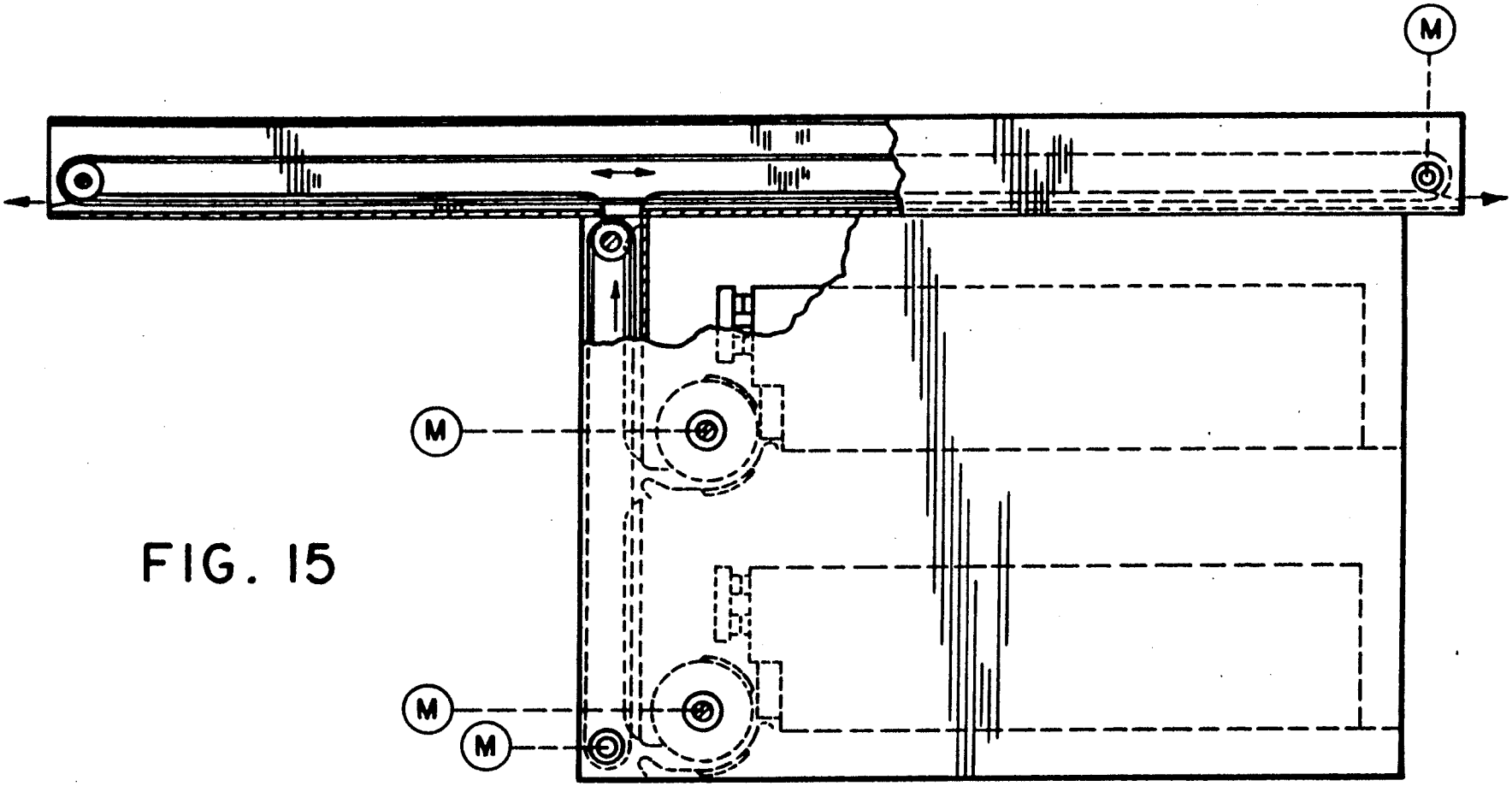
FIG. 15 is a side elevational view of a media dispensing mechanism illustrating an alternate embodiment of the present invention.

Although the invention has been described with respect to a preferred embodiment, modifications will occur to others upon their reading and understanding of the specification. For example, while the present invention has been described with respect to a stacking device and mechanism for diverting bills to a "divert/dump location", a media dispensing device can be provided utilizing a transport system as herein described without the additional features. In this respect, FIG. 15 discloses a media dispensing apparatus illustrating an alternate embodiment of the present invention wherein feed module 34 is combined with a transport module 800 having a horizontal transport 805 comprised of a plurality of side-by-side parallel endless belts 810 aligned with juxtaposed rails 820. Belts 810 are driven by a reversible motor 830. Depending on the direction of belts 810, notes may be dispensed from either end of module 800.

It will also be appreciated that the media dispenser shown in FIGS. 1–14 could be easily modified to dispense a stack of notes from the other end of transport module 38 to provide a "front" loading and dispensing device (FIGS. 1–14 show a "rear" loading device). In this respect, one basically need only provide gate assembly 500 on the other end of module 38 and program dispenser processor 18 to sequence and position the respective components, primarily push plate 410 to accommodate for such a change. In this respect, essentially all the components would function the same, but the back side of push plate 410 would push the stack of notes toward the dispensing opening. Repositioning gate assembly 500 and reprogramming dispenser processor 18 would clearly be within the ability of those skilled in the art upon a reading and understanding of the present specification. Still further, while media dispenser 16 was described as having two canisters 50, it will be appreciated that a media dispenser may have more or less than two canisters without deviating from the present invention. These and other modifications will occur to others upon reading and understanding of the specification. It is intended that all such modifications and alterations be included in so far as they come within the scope of the patent as claimed or the equivalents thereof.

Having thus described the invention, the following is claimed:

1. A device for dispensing sheet media comprising:

storage means for storing sheet media to be dispensed;

receiving means accessible to a patron from which said sheet media may be received;

receptacle means for retaining sheets of said media;

stacking means for stacking individual sheets of said sheet media into a stack;

transport means for transporting sequentially individual sheets from said storage means to said stacking means and for transporting sheets of said media from said receiving means to said receptacle means, said transport means comprised of:

generally planar surface means, and at least three spaced apart, side-by-side, endless drive belts having an outer frictional surface, each of said drive belts having a portion thereof extending along said planar surface means wherein said frictional surfaces of said belts are disposed opposing and generally parallel to said planar surface means, said drive belts operable to drive said sheet media along said planar surface means by frictional engagement between said drive belts and said sheet media;

transfer means for transferring one or more of said sheets from said stacking means to said receiving means; and, divert means associated with said transport means operable to cause selected sheets transported from said storage means to said stacking means to be diverted to said receptacle means, said stacking means and said divert means forming a portion of said planar surface means.

2. A device as defined in claim 1 further comprising sensing means for sensing said selected sheets, wherein said divert means causes said selected sheets to be diverted to said receptacle means.

3. A device as defined in claim 1 wherein said planar surface means defines at least two spaced-apart, side-by-side, parallel rails, said rails being parallel to and juxtaposed with said belts to define an undulating passage therebetween.

4. A device as defined in claim 1 further comprising control means for coordinating and controlling said stacking means and said divert means.

5. A device as defined in claim 4 further comprising gate means for controlling access to said receiving means.

6. A device as defined in claim 5 wherein said gate means is controlled by said control means.

7. A device for dispensing sheet media comprising:

storage means for storing sheet media to be dispensed;

receiving means accessible to a patron from which said sheet media may be received;

receptacle means for retaining sheets of said media;

stacking means for stacking individual sheets of said sheet media into a stack, transport means for transporting individual sheets from said storage means to said stacking means and for transporting sheets of said media from said receiving means to said receptacle means;

transfer means for transferring a stack of sheets from said stacking means to said receiving means;

divert means associated with said transport means operable to cause sheets transported from said storage means to said stacking means to be diverted to said receptacle means;

gate means for controlling access to said receiving means; and control means for coordinating and controlling said stacking means and said divert means, said control means including a structural member which is rotatable about a fixed axis which includes cam means operatively engaging said stacking means, said divert means and said gate means.

8. A device for dispensing sheet media comprising:

storage means for storing sheet media to be dispensed;

receiving means accessible to a patron from which said sheet media may be received;

receptacle means for retaining sheets of said media;

stacking means for stacking one or more sheets of said sheet media into a stack, said stacking means comprised of a generally planar member having spaced-apart, side-by-side rails thereon, said planar member being movable between a first position for stacking said sheet media and a second position;

transport means for transporting individual sheets from said storage means to said stacking means and for transporting sheets of said media from said receiving means to said receptacle means, said transport means comprised of:

generally planar surface means, and at least three spaced-apart, side-by-side, endless drive belts having an outer frictional surface, each of said drive belts having a portion thereof extending along said surface means wherein said frictional surfaces of said belts are disposed opposing and generally parallel to said surface means, said planar member of said stacking means being generally parallel to and spaced from said portion of said drive belts which extend along said surface means when said planar member is in said second position, said rails on said planar member being parallel to and juxtaposed with said belts;

transfer means for transferring a stack of sheets from said stacking means to said receiving means; and divert means associated with said transport means operable to cause sheets transported from said storage means to said stacking means to be diverted to said receptacle means.

9. A device as defined in claim 8 wherein said divert means is comprised of a generally planar divert member having spaced-apart, side-by-side, parallel rails thereon, said rails being aligned with said rails on said stacking member, said planar divert member being movable along an axis generally parallel to said rails.

10. A device for handling and feeding sheet media comprising:

elongated surface means defining a linear path along which said sheets are driven, said surface means including at least two spaced-apart, side-by-side, parallel elongated surfaces, lying in a common plane extending along said linear path;

at least three spaced-apart, side-by-side, endless drive belts having an outer frictional surface, each of said drive belts having a portion thereof extending along said surface means wherein said frictional surfaces are disposed opposing and generally parallel to said surface means, said portions of said drive belts being parallel to and juxtaposed with said elongated surfaces to define an undulating passage to confine said sheet between said frictional surfaces of said drive belts and said elongated surfaces;

belt drive means for simultaneously driving said belts; and stacking means associated with said drive belts for stacking said sheet media, said stacking means including a plurality of elongated side-by-side parallel surfaces lying in a common plane and being movable between a first location for stacking sheets of said sheet media and a second position wherein said elongated side-by-side parallel surfaces on said stacking means are aligned along said path with said elongated surfaces of said elongated surface means and are co-planar therewith.

11. A device as defined in claim 10 further comprising divert means associated with said drive belts and said stacking means for selectively diverting sheets from said stacking means.

12. A device as defined in claim 11 wherein said divert means includes a plurality of elongated, side-by-side parallel surfaces lying in the plane defined by the elongated surfaces of said surface means and being aligned therewith, said divert means being movable along said path between a first nondiverting position and a second position wherein said divert means obstructs said stacking means.

13. A device for handling and feeding sheet media comprising:

elongated surface means defining a linear path along which said sheets are driven, said surface means including at least two spaced-apart, side-by-side, parallel elongated surfaces, lying in a common plane extending along said linear path;

at least three spaced-apart, side-by-side, endless drive belts having an outer frictional surface, each of said drive belts having a portion thereof extending along said surface means wherein said frictional surfaces are disposed opposing and generally parallel to said surface means, said portions of said drive belts being parallel to and juxtaposed with said elongated surfaces to define an undulating passage to confine said sheet between said frictional surfaces of said drive belts and said elongated surfaces;

belt drive means for simultaneously driving said belts;

stacking means associated with said drive belts for stacking said sheet media;

divert means associated with said drive belts and said stacking means for selectively diverting sheets from said stacking means; and control means for coordinating movement of said stacking means and said divert means relative to said belts, said control means comprised of a rotatable element movable about a fixed axis having cam surfaces operatively engaging said stacking means and said divert means.

14. A device as defined in claim 13 wherein:

said stacking means includes a plurality of elongated side-by-side parallel surfaces lying in a common plane and being movable between a first location for stacking sheets of said sheet media and a second position wherein said elongated surfaces on said stacking means are aligned along said path with said elongated surfaces of said surface means and are co-planar therewith; and, said divert means includes a plurality of elongated, side-by-side parallel surfaces lying in the plane defined by the elongated surfaces of said surface means and being aligned therewith, said divert means being movable along said path between a first non-diverting position and a second position wherein said divert means obstructs said stacking means.

15. A device as defined in claim 15 further comprising transfer means associated with said belts for moving a stack of sheets from said stacking means to a receiving location.

16. A device for handling and feeding sheet material comprising:

an elongated, generally flat first surface means defining a path along which said sheet material is driven;

at least three spaced-apart, side-by-side, endless drive belts having an outer frictional surface, each of said drive belts having a portion thereof extending along said surface means wherein said frictional surfaces are disposed opposing and generally parallel to said surface means to confine said sheet material between said frictional surface of said drive belts and said surface means;

belt drive means for simultaneously driving said belts;

stacking means positioned along said path defined by said first surface means in operative relation with said belts for stacking said sheet material into a uniform stack, said stacking means including:

a generally planar stacking plate capable of reciprocal movement between a first position for stacking said sheet material and a second position wherein said plate is generally co-planar with said surface means and in operative engagement with said belts; and, means for aligning one edge of said sheet material into a uniform stack.

17. A device as defined in claim 16 wherein said aligning means comprises:

a generally planar wall associated with said stacking plate; and, a paddle wheel assembly which is operable to engage the surface of said sheets and to urge said sheets against said planar wall.

18. A device as defined in claim 17 wherein said paddle wheel assembly comprises:

annular hubs having a plurality of resilient straps extending radially therefrom, wherein said resilient straps are comprised of material capable of gripping said sheet material.

19. A device for handling and feeding sheet material comprising:

an elongated, generally flat first surface means defining a path along which said sheet material is driven;

at least three spaced-apart, side-by-side, endless drive belts having an outer frictional surface, each of said drive belts having a portion thereof extending along said surface means wherein said frictional surfaces are disposed opposing and generally parallel to said surface means to confine said sheet material between said frictional surfaces of said drive belts and said surface means;

dispensing means for dispensing said sheet material;

belt drive means for simultaneously driving said belts;

storage means for storing said sheet material to be dispensed;

holding means for holding predetermined sheets of said sheet material;

diverting means positioned along said path in operative engagement with said belts for diverting said predetermined sheets from said dispensing means to said holding means, said diverting means including a generally planar divert plate having surfaces defining a portion of said path along which said sheets are driven, said plate being capable of reciprocal movement along said path from a first position for dispensing said sheet material to a second position for diverting said predetermined sheets to said holding means.

20. A device for handling and feeding sheet material comprising:

an elongated, generally flat first surface means defining a generally planar, straight path along which said sheet material is driven, transport means to convey sheet material along said path, stacking means located along said path for stacking said sheet material into a uniform stack, said stacking means being operatively disposed along said path and having a stacking surface alignable with said first surface means to form a portion of said path;

divert means located along said path for diverting selected sheets away from said stacking means into a receptacle for receiving and holding said selected sheets, said divert means being operatively disposed along said path and including divert surface means aligned with said first surface means to form a portion of said path;

dispensing means located at an end of said path for dispensing a stack of one or more of said sheets, said dispensing means including gate means; and transfer means movable along said path for driving a stack of one or more of said sheet material from said stacking means along said first surface means to said dispensing means.

21. A device as defined in claim 20 wherein said transfer means is comprised of a push plate reciprocally movable from a first position to a second position adjacent said dispensing means.

22. A device as defined in claim 21 further comprising control means for coordinating movement of said divert means and said stacking means.

23. A device as defined in claim 22 wherein said control means, said push plate, said transfer means, and said gate are controlled by a central processing unit.

24. A device as defined in claim 21 wherein said stacking means is comprised of a generally planar stack plate having a planar upper surface, said stack plate being movable between a first position for stacking said sheets and a second position wherein said upper surface of said stack plate is aligned with said first surface means; and wherein said divert means is comprised of a generally planar divert plate having a planar upper surface aligned with said first surface means, said divert plate being movable between a first position for dispensing said sheet material and a second position for diverting said selected sheets to said receptacle.

25. An apparatus for dispensing sheet media comprising:

a housing for containing sheet media to be dispensed;

receiving means accessible to a patron from which said sheet media may be received;

means for receiving identification information from a patron;

means for utilizing said identification information to determine whether said patron has a dispensing authorization status;

means for receiving dispensing information from a patron;

a computer unit having means for receiving identification information and dispensing information from a patron and for generating output instructional information and control signals in response thereto and;

sheet media dispensing means including:

at least one sheet media transport comprised of generally planar surface means having at least two side-by-side elongated surfaces which lie in a common plane and which extend parallel to each other, said planar surface means defining a generally linear path; and, at least three spaced-apart, side-by-side, parallel endless belts having outer frictional surfaces, each of said belts having a portion thereof extending parallel to said elongated surfaces, said belts being juxtaposed and spaced from said elongated surfaces to form an undulated passage therebetween to receive individual sheets of said sheet media;

belt drive means responsive to said control signals for moving said belts along said generally planar surface means wherein said belts are operative to drive said sheets along said side-by-side elongated surfaces, and stacking means for stacking said sheet media, and divert means for diverting irregular sheet media from said stacking means, said stacking means and said divert means including movable surface means positionable to form part of said generally planar surface means.

26. An apparatus for dispensing sheet media comprising:

a housing for containing sheet media to be dispensed;

receiving means accessible to a patron from which said sheet media may be received;

means for receiving identification information from a patron;

means for utilizing said identification information to determined whether said patron has a dispensing authorization status;

means for receiving dispensing information from a patron;

a computer unit having means for receiving identification information and dispensing information from a patron and for generating output instructional information and control signals in response thereto;

sheet media dispensing means including:

at least one sheet media transport comprised of surface means having at least two side-by-side elongated surfaces which lie in a common plane and which extend parallel to each other to define a generally linear path, at least three spaced-apart, side-by-side, parallel endless belts having outer frictional surfaces, each of said belts having a portion thereof extending parallel to said elongated surfaces, said belts being juxtaposed and spaced from said elongated surfaces to form an undulated passage therebetween to receive individual sheets of said sheet media wherein said belts are operative to drive said sheets along said surfaces;

stacking means disposed along said path for stacking said sheet media, said stacking means includes elevated rails having elongated surfaces which are movable between a first position wherein a stack of sheet media may be formed on said elongated surfaces and a second position wherein said elongated surfaces are aligned with said elongated surfaces of said surface means and in operative relationship with said belts; and divert means disposed along said path for diverting irregular sheet media from said stacking means.

27. An apparatus as defined in claim 26 wherein said stacking means is comprised of:

a stacking plate having elevated rails thereon, the upper surfaces of said rails defining the elongated surfaces of said stacking means, said plate being movable between a first position for stacking said sheets wherein said stacking plate is disposed from said linear path and a second position wherein said elongated surfaces on said stacking plate are aligned with said elongated surfaces on said surface means.

28. An apparatus as defined in claim 27 wherein said stacking means further includes aligning means for aligning one edge of the sheets.

29. An apparatus as defined in claim 28 wherein said divert means includes elevated rails defining elongated surfaces which are aligned with said elongated surfaces on said surface means and which are movable along said linear path.

30. An apparatus as defined in claim 29 further comprising control means controlled by said computer unit for coordinating movement of said stacking means and said divert means.

31. An apparatus as defined in claim 30 wherein said control means is comprised of a rotatable member pivotable about a fixed axis, said member including cam surfaces in operative engagement with said stacking means and said divert means.

32. An apparatus as defined in claim 31 further comprising transfer means for transferring a stack of sheets from said stacking means to said receiving means.

33. A device for dispensing sheet media comprising:

storage means for storing said sheet media to be dispensed;

elongated surface means defining a generally planar, straight path along which said sheet material is to be driven;

access means at one end of said path from which said sheet media may be dispensed as a single sheet or a stack of sheets;

means for conveying individually said sheet media from said storage means to said path;

stacking means operable to stack individual sheets into a stack of sheets, said stacking means including generally planar stacking surface means movable relative to said path between a first position wherein said stacking surface means is aligned with said elongated surface means and forms a portion of said path and a second position wherein said stacking surface means is displaced from said elongated surface means;

divert means for selectively diverting select sheets of said sheet media away from said stacking means, said divert means including generally planar divert surface means which is reciprocally movable along said path and aligned with said elongated surface means forming said path; and, conveyor belt means adjacent said path, said belt means being in operative relation to said elongated surface means, said stacking surface means and said divert surface means to convey said sheet media by frictional engagement along said elongated surface means and said divert surface means and along said stacking surface means when said stacking surface means is in said first position.

34. A device as defined in claim 33 further comprising control means for coordinating and controlling said stacking and said divert means, said control means mechanically connecting operation of said divert means with said stacking means.

35. A device as defined in claim 33 wherein said elongated surface means, said stacking surface means and said divert surface means include elongated, generally parallel, side-by-side rails, the upper surface of which defines the surface along which said sheet media is conveyed.

* * * * *